US007374659B1

(12) United States Patent
Burris et al.

(10) Patent No.: US 7,374,659 B1
(45) Date of Patent: May 20, 2008

(54) METHODS AND SYSTEMS FOR MODIFYING ASPHALTS

(75) Inventors: Michael V. Burris, Carlsbad, CA (US); Bryan B. Burris, Carlsbad, CA (US); Hossein Ajideh, Carlsbad, CA (US)

(73) Assignee: Asphalt Technology, LLC., Carlsbad, CA (US)

( * ) Notice: Subject to any disclaimer, the term of this patent is extended or adjusted under 35 U.S.C. 154(b) by 512 days.

(21) Appl. No.: 11/157,687

(22) Filed: Jun. 21, 2005

Related U.S. Application Data

(60) Provisional application No. 60/581,667, filed on Jun. 22, 2004.

(51) Int. Cl.
*C10C 3/04* (2006.01)

(52) U.S. Cl. ..... 208/22; 208/44

(58) Field of Classification Search ..... 208/22, 208/44

See application file for complete search history.

(56) References Cited

U.S. PATENT DOCUMENTS

| | | | |
|---|---|---|---|
| 1,782,186 | A | 11/1930 | Abson |
| 2,179,208 | A | 11/1939 | Burk et al. |
| 2,200,914 | A | 5/1940 | Burk et al. |
| 2,370,007 | A | 2/1945 | Carr |
| 2,375,117 | A | 5/1945 | Lentz |
| 2,450,756 | A | 10/1948 | Hoiberg |
| 3,126,329 | A | 3/1964 | Fort |
| 3,462,359 | A | 8/1969 | Hammond |
| 3,652,445 | A | 3/1972 | Senolt et al. |
| 3,833,528 | A | 9/1974 | Behling et al. |
| 3,923,633 | A | 12/1975 | Senolt et al. |
| 3,935,093 | A | 1/1976 | Senolt et al. |
| 3,952,137 | A | 4/1976 | Turler |
| 4,338,137 | A | 7/1982 | Goodrich |
| 4,436,864 | A | 3/1984 | Grossi et al. |
| 4,440,579 | A | 4/1984 | Eidem |
| 4,456,523 | A | 6/1984 | Carlos et al. |
| 4,456,524 | A | 6/1984 | Wombles et al. |

(Continued)

FOREIGN PATENT DOCUMENTS

| | | |
|---|---|---|
| EP | 0 078 701 B1 | 1/1986 |

(Continued)

OTHER PUBLICATIONS

ASTM D8-97. Standard Terminology Relating to Materials for Roads and Pavements. *Annual Book of ASTM Standards*, vol. 04.03, American Society for Testing and Materials, West Conshohocken, PA, 1999.

(Continued)

*Primary Examiner*—Tam Nguyen
(74) *Attorney, Agent, or Firm*—Knobbe Martens Olson & Bear LLP.

(57) ABSTRACT

A method for modifying asphalt comprises blowing an oxygen-containing gas through a base asphalt at a high gas flow rate while simultaneously agitating the base asphalt at a high shear rate and at an elevated temperature for a period of time that is effective to substantially improve at least two paving properties of the base asphalt. In preferred embodiments, modified asphalts are produced having both substantially improved rutting resistance and substantially improved fatigue resistance as compared to the base asphalt.

19 Claims, 17 Drawing Sheets

U.S. PATENT DOCUMENTS

| | | | | | |
|---|---|---|---|---|---|
| 4,618,373 | A | * | 10/1986 | Eidem | 106/284.2 |
| 4,750,984 | A | | 6/1988 | Ott | |
| 4,882,373 | A | | 11/1989 | Moran | |
| 4,975,176 | A | | 12/1990 | Begliardi et al. | |
| 5,284,509 | A | | 2/1994 | Kamel et al. | |
| 5,302,638 | A | * | 4/1994 | Ho et al. | 524/59 |
| 5,336,705 | A | | 8/1994 | Gorbaty et al. | |
| 5,342,866 | A | | 8/1994 | Trumbore et al. | |
| 5,364,894 | A | | 11/1994 | Portfolio et al. | |
| 5,397,818 | A | | 3/1995 | Flanigan | |
| 5,421,876 | A | | 6/1995 | Janoski | |
| 5,549,744 | A | | 8/1996 | Puzic et al. | |
| 5,863,971 | A | | 1/1999 | Baanders et al. | |
| 5,981,632 | A | * | 11/1999 | Fields | 524/60 |
| 6,060,542 | A | | 5/2000 | Gooswilligen et al. | |
| 6,087,419 | A | | 7/2000 | Fields | |
| 7,060,743 | B2 | * | 6/2006 | Deygout et al. | 524/68 |
| 7,202,290 | B2 | * | 4/2007 | Stuart et al. | 524/68 |

FOREIGN PATENT DOCUMENTS

| | | |
|---|---|---|
| EP | 0 459 811 B1 | 10/1994 |
| EP | 0 618 274 A1 | 10/1994 |
| WO | WO 9317076 | 9/1993 |

OTHER PUBLICATIONS

Billiter, T.C., RR Davison,C. J. Glover, and J.A. Bullin. Production of Asphalt-Rubber Binders by High-Cure Conditions. In *Transportation Research Record* 1586, TRB National Research Council, Washington D.C., 1997, pp. 50-56.

Billiter, T.C., J.S. Chun, R.R Davison, C.J. Glover, and J.A. Bullin. Investigation of the Curing Variables of Asphalt-Rubber Binder. *Petroleum Science and Technology*, vol. 15, No. 5&6, 1997, pp. 445-469.

Chipps, J.F., T.C. Billiter, RR Davison, and C.J. Glover. Oxidative Aging of Asphalt Rubber and Implications to Performance Analysis. *ACS Preprint*, vol. 43, No. 4, Boston, MA, Aug. 22-27, 1998, pp. 1057-1062.

Davison, RR, N.Y. Vassiliev, S.A. Williamson, and C.J. Glover. Producing Superior Asphalts Through Air Blowing. To be presented at the 218th ACS National Meeting in New Orleans, LA, Aug. 22-26, 1999.

Glover et al., A Comprehensive Laboratory and Field Study Of High-Cure Crumb-Rubber Modified Asphalt Materials, Report 1460-1, Jan. 2000.

Kamel, et al., "Critlcal Laboratory Evaluation of Asphalt Binders Modified by Refining Processes," 49th Annual CTAA Conference, Montreal, Nov. 22, 2004.

* cited by examiner

METHODS AND SYSTEMS FOR MODIFYING ASPHALTS

CROSS-REFERENCE TO RELATED APPLICATION

This application claims priority to U.S. Provisional Patent Application No. 60/581,667, filed Jun. 22, 2004, which is hereby incorporated by reference in its entirety.

BACKGROUND OF THE INVENTION

1. Field of the Invention

This invention generally relates to methods for making modified asphalt materials.

2. Description of the Related Art

Conventional air-blowing of asphalt materials involves passing an oxidizing gas through the asphalt in a molten condition. In general, the effect of such conventional air-blowing is to partially oxidize the asphalt, resulting in decreased penetration and increased viscosity and softening point. However, for paving applications, such conventional air-blowing generally has a negative effect on the fatigue resistance and the low temperature properties.

The disclosures of the following references are hereby incorporated by reference in their entireties: U.S. Pat. Nos. 1,782,186; 2,179,208; 2,370,007; 2,450,756; 3,126,329; 3,462,359; 4,338,137; 4,440,579; 4,456,523; 4,456,524; 5,284,509; 5,336,705; 5,342,866; and 6,087,419. The following EPO patent documents are also hereby incorporated by reference in their entireties: EP 0 459 811 B1 and EP 0 618 274 A1.

SUMMARY OF THE INVENTION

Methods for making modified asphalts have been developed that involve blowing an oxygen-containing gas through a base asphalt while simultaneously subjecting the base asphalt to elevated temperatures and high levels of shear. Surprisingly, it has been found that the modified asphalts have both substantially improved rutting resistance and substantially improved fatigue resistance as compared to the base asphalts.

An embodiment provides a method for making a modified asphalt, comprising:

blowing an oxygen-containing gas through a base asphalt at a high gas flow rate while simultaneously agitating the base asphalt at a high shear rate and at an elevated temperature for a treatment time to thereby produce a modified asphalt;

wherein the high gas flow rate, the high shear rate, the elevated temperature and the treatment time are all selected to substantially improve both the rutting resistance and the fatigue resistance of the modified asphalt as compared to the base asphalt.

Another embodiment provides a modified asphalt made by such a method.

In another embodiment provides a method for making a back-blended asphalt, comprising:

blowing an oxygen-containing gas through a base asphalt at a high gas flow rate while simultaneously agitating the base asphalt at a high shear rate and at an elevated temperature for a treatment time to thereby produce a modified asphalt, wherein the high gas flow rate, the high shear rate, the elevated temperature and the treatment time are all selected to substantially improve both the rutting resistance and the fatigue resistance of the modified asphalt as compared to the base asphalt; and blending the modified asphalt with a second base asphalt to produce a back-blended asphalt, wherein the modified asphalt is blended with the second base asphalt in an amount that is effective to improve both the rutting resistance and the fatigue resistance of the back-blended asphalt as compared to the second base asphalt.

Another embodiment provides a back-blended asphalt made by such a method.

Another embodiment provides a system for modifying asphalt, comprising:

a container for holding a base asphalt, the container comprising a source for an oxygen-containing gas;

a gas controller configured to introduce the oxygen-containing gas into the base asphalt at a high gas flow rate, a mixer configured to agitate the base asphalt at a high shear rate;

a temperature controller operably connected to the container and configured to control the temperature of the base asphalt; and a system controller configured to control at least one of the gas controller, the mixer, and the temperature controller.

These and other embodiments are described in greater detail below.

DETAILED DESCRIPTION OF THE PREFERRED EMBODIMENTS

Figure 1A:
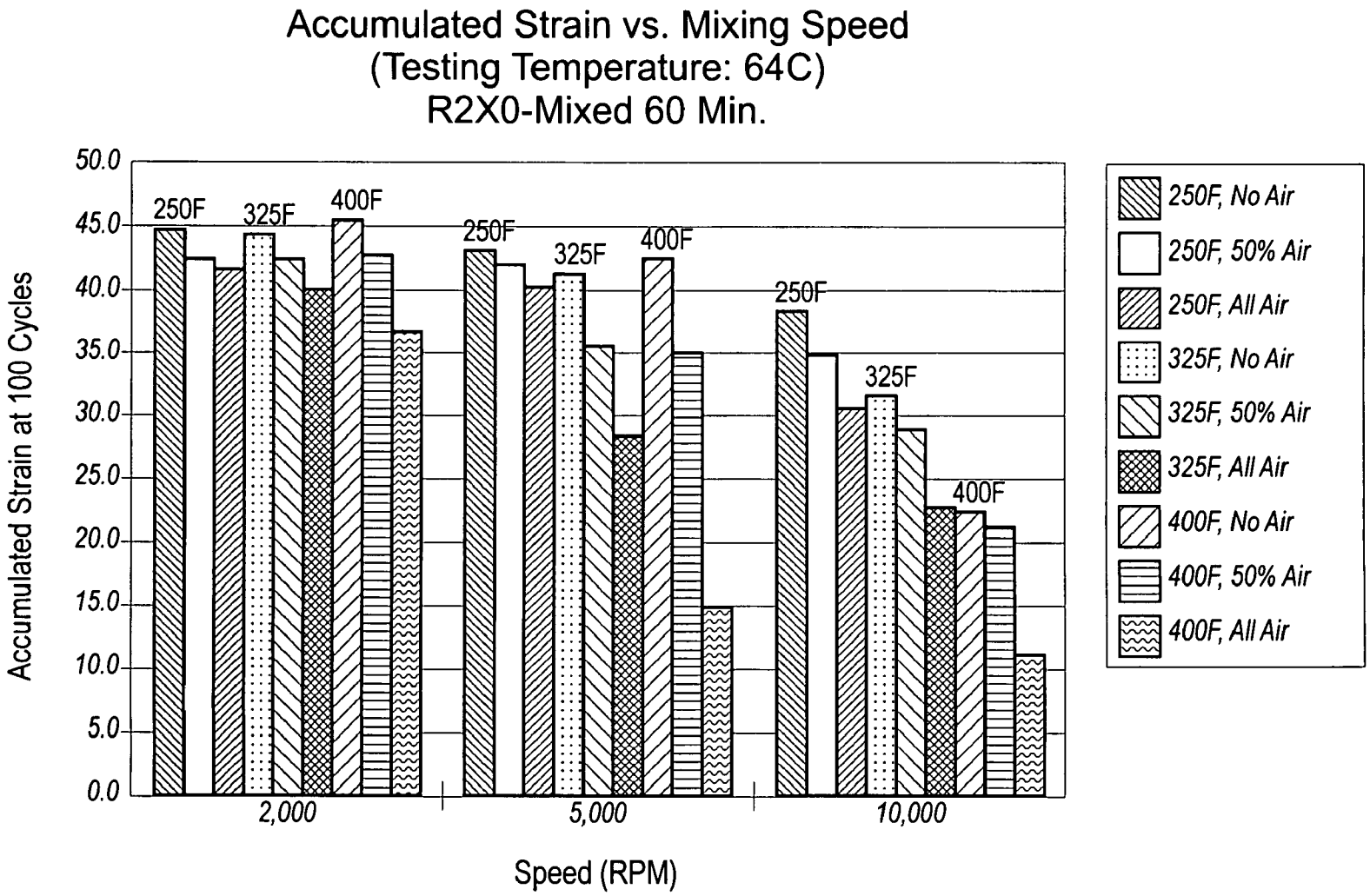
FIGS. 1A and 1B show bar graphs summarizing Creep and Recovery test results for a series of modified asphalts, demonstrating the degree to which rutting resistance is improved by the various combinations of elevated temperature, air blowing and shear rate.

The term "asphalt" is used herein in its ordinary sense and thus includes a variety of dark-colored relatively viscous hydrocarbon-containing materials that are produced from petroleum feedstocks and/or residues. Examples of such asphalts are those typically used in roofing and paving applications. A base asphalt is an asphalt from which a modified asphalt is produced by, e.g., the preferred asphalt modification methods described herein. A first modified asphalt made be further modified to make a second modified asphalt, and thus the term "base asphalt" includes previously modified asphalts and asphalts modified in previous stages of the modification process. Non-limiting examples of base asphalts include the AR-8000 asphalts commercially available from San Joaquin Refining and Valero Benicia (California). An asphalt may be referred to as an asphalt binder or simply as a binder, e.g., in the context of asphalts suitable for paving applications.

An embodiment provides a method for making a modified asphalt, comprising blowing an oxygen-containing gas (e.g., air) through a base asphalt at a high gas flow rate while simultaneously agitating the base asphalt at a high shear rate and at an elevated temperature for a treatment time to thereby produce a modified asphalt; wherein the high gas flow rate, the high shear rate, the elevated temperature and the treatment time are all selected to substantially improve at least two paving properties of the modified asphalt as compared to the base asphalt. In an embodiment, at least three paving properties are substantially improved as compared to the base asphalt. Non-limiting examples of paving properties that may be substantially improved by the practice of this embodiment include rutting resistance, fatigue resistance, tensile strength, and PG grade. Various paving properties are described in the AASHTO Standards referred to below, and/or the Testing Methods According to NCHRP 9-10 (National Cooperative Highway Research Program) Report 459 referred to below, both of which also describe various test methods for determining whether a paving property is substantially improved. Substantial improvements in rutting resistance (as evidenced by, e.g., substantially decreased accumulated strain), fatigue resistance (as evidence by, e.g., increased number of cycles before failure), and PG grade may be measured as described in the Examples below. An improvement in a paving property of about 10% or more is considered substantial. In a preferred embodiment, substantial improvements of about 25% or more in a paving property may be obtained, more preferably 50% or more, even more preferably 100% or more. With respect to improvements in PG grade, an increase of at least one grade is considered a substantial improvement in a paving property.

Various tests are available for measuring paving properties such as rutting resistance and fatigue resistance, and those skilled in the art may select the appropriate test in light of the circumstances of a particular situation in order to determine whether the paving property of the modified asphalt is substantially improved as compared to the base asphalt. In most cases the results of the various tests are sufficiently similar that the selection of the testing method may be made of the basis of practical criteria such as cost, timing and equipment availability. The testing methods set forth in the AASHTO Standards referred to below and in the Testing Methods According to NCHRP 9-10 (National Cooperative Highway Research Program) Report 459 referred to below are considered "standard" test methods for determining whether the paving property of the modified asphalt is substantially improved as compared to the base asphalt. In a given situation, if a particular non-standard paving property test result is in conflict with a particular standard paving property test result, then the standard paving property test result is used for determining the paving property. Notwithstanding the foregoing, paving property test results obtained by the methods described in the Examples set forth below (and/or in the Examples set forth in U.S. Provisional Patent Application No. 60/581,667, filed Jun. 22, 2004) take precedence over both standard and non-standard paving property test results for the determination of whether the paving property of a modified asphalt is substantially improved as compared to the base asphalt.

It will be understood that an improvement in a paving property may be evidenced by a decrease in a particular test value used in the determination of that paving property. For example, accumulated strain is a parameter that is directly related to permanent deformation, and thus may be used as an indicator of the rutting resistance of the asphalt. Those skilled in the art understand that a lower accumulated strain value is an indicator of higher rutting resistance, and thus a substantial improvement in a paving property such as rutting resistance may be evidenced by an accumulated strain value for the modified asphalt that is, e.g., less than about 50% of the accumulated strain value for the base asphalt, preferably less than about 70% of the accumulated strain value for the base asphalt. Accumulated strain values may be measured by Creep and Recovery tests conducted for 100 cycles at 64° C. as described in the Examples below. Creep and Recovery tests may also be conducted at other high temperatures (e.g., 70° C., 76° C., 82° C.) determined according to MP1, depending on the Maximum Pavement Design Temperature and the PG grade of the asphalt in a manner known to those skilled in the art.

In other cases, an improvement in a paving property may be evidenced by an increase in a particular test value used in the determination of that paving property. For example, a substantially improved fatigue life may be evidenced by a fatigue life value for the modified asphalt that is at least about twice a fatigue life value for the base asphalt, preferably at least about three times a fatigue life value for the base asphalt. Fatigue life values for the modified asphalt and for the base asphalt may be determined by Repeated Cyclic Loading tests conducted at 34° C. and 10 Hz, as described in the Examples below. Repeated Cyclic Loading tests are preferably conducted at an intermediate temperature (IT) appropriate for the asphalt in light of the anticipated climate conditions (e.g., 34° C., 37° C., 40° C.) and at a frequency (e.g., 1.6 Hz, 10 Hz) selected in light of anticipated traffic conditions, in a manner known to those skilled in the art. The determination of IT is preferably based on whether freeze-thaw cycles occur in the region or not. If the freeze-thaw phenomenon is predominant, the IT is preferably 12° C. If the freeze-thaw phenomenon is rare, the IT should be average of HT and LT determined according to MP1.

Figure 1B:
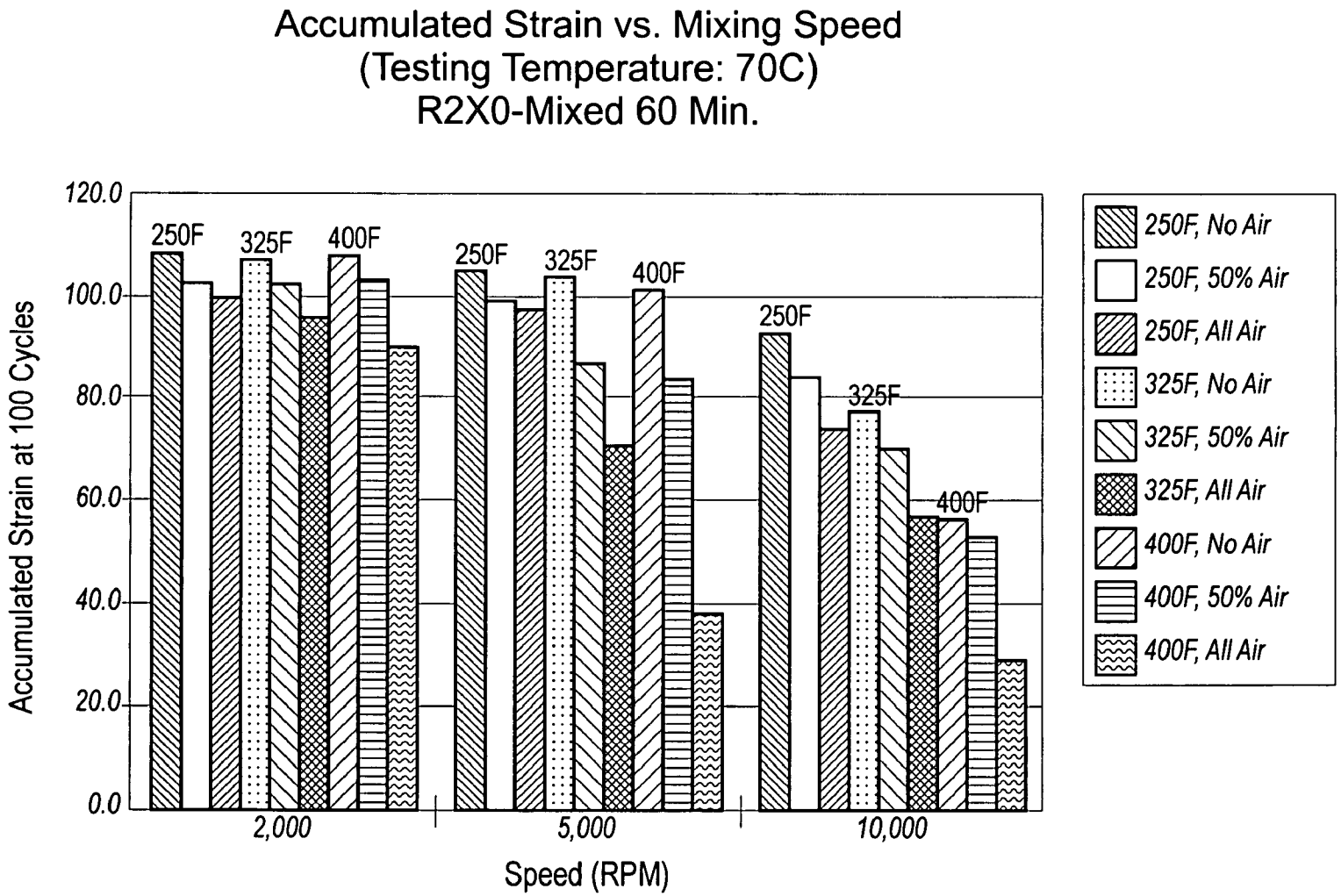

In some embodiments, the paving properties that are substantially improved are improved by a synergistic combination of any two or more process parameters, preferably three or more process parameters, selected from group consisting of the high gas flow rate, the high shear rate, the elevated temperature, and the treatment time. For example, as illustrated in FIG. 1 and the Examples below, increases in treatment temperature, e.g., from 250° F. to 400° F., at a shear rate of 2,000 rpm in the absence of air-blowing, tend to result in little or no change in accumulated strain. However, in the presence of air-blowing, substantial improvements in accumulated strain are obtained, particularly at higher temperatures and shear rates. In preferred embodiments, at least one paving property selected from the group consisting of rutting resistance, fatigue resistance and PG grade is substantially improved by a synergistic combination of any two or more process parameters, preferably three or more process parameters, selected from group consisting of the high gas flow rate, the high shear rate, the elevated temperature, and the treatment time.

A preferred embodiment provides a method for making a modified asphalt, comprising blowing an oxygen-containing gas (e.g., air) through a base asphalt at a high gas flow rate while simultaneously agitating the base asphalt at a high shear rate and at an elevated temperature for a treatment time to thereby produce a modified asphalt; wherein the high gas flow rate, the high shear rate, the elevated temperature and the treatment time are all selected to substantially improve both the rutting resistance and the fatigue resistance of the modified asphalt as compared to the base asphalt. The achievement of substantial improvements in both rutting resistance and the fatigue resistance is surprising because the conventional wisdom is generally that while air-blowing may in some cases increase rutting resistance, it also increases the stiffness and brittleness of the base asphalt, resulting in a negative effect on fatigue resistance and/or low temperatures properties.

Figure 4A:
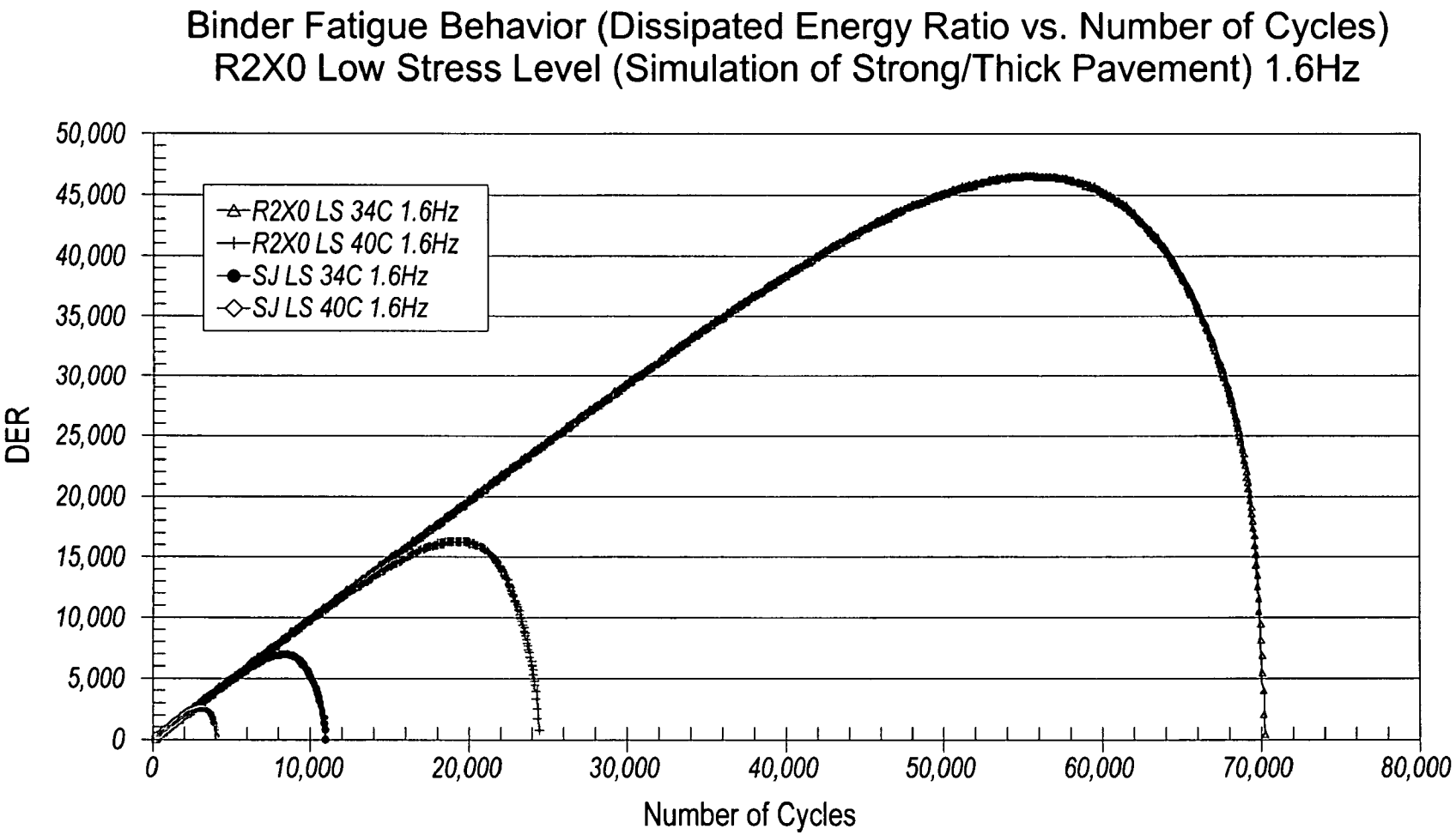
FIGS. 4A and 4B show plots of DER values obtained as a function the number of cycles to failure for a modified asphalt and the corresponding base asphalt, demonstrating the degree to which fatigue resistance is improved for the modified asphalt as compared to the base asphalt.
Figure 4B:
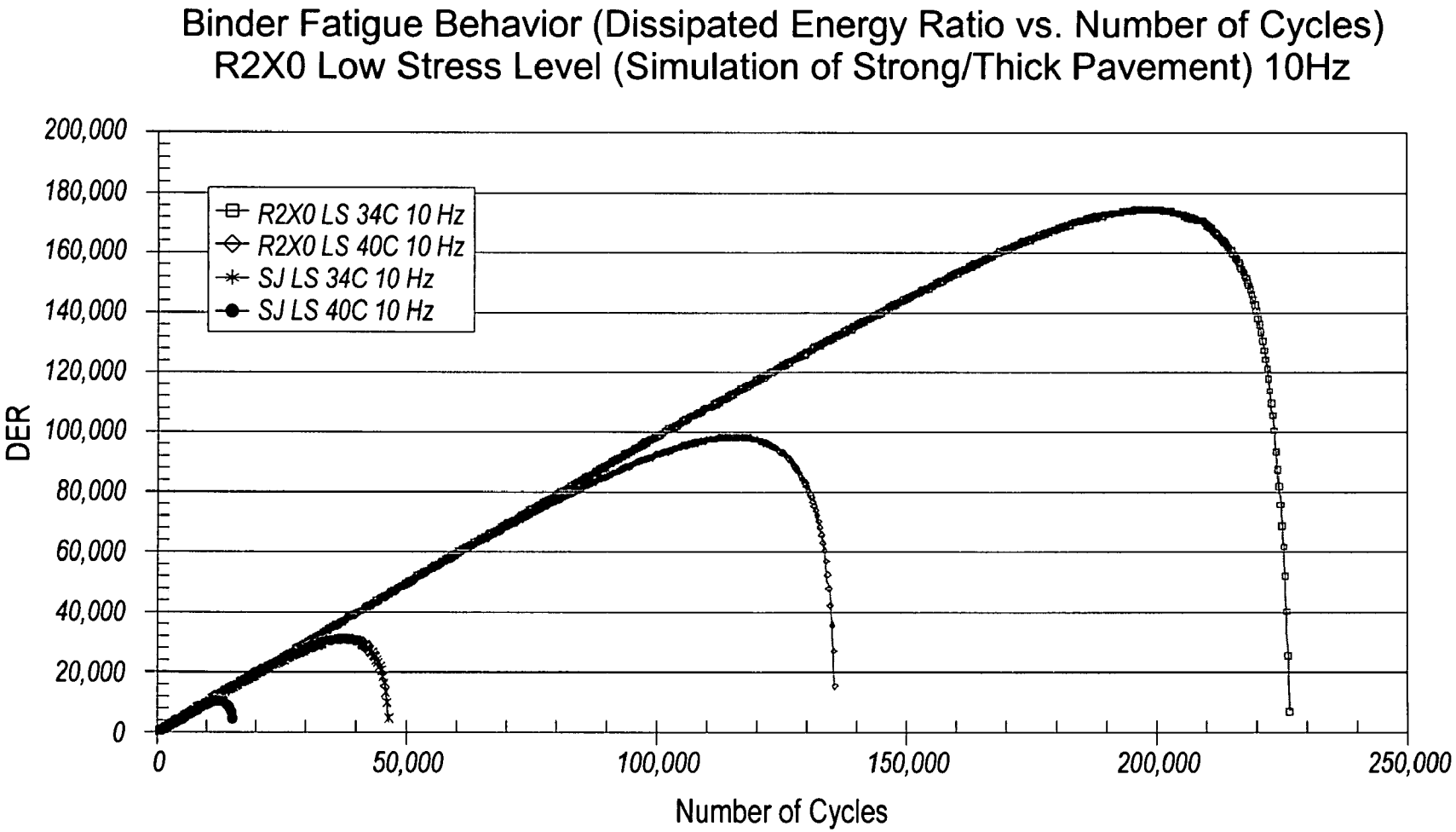
Figure 5:
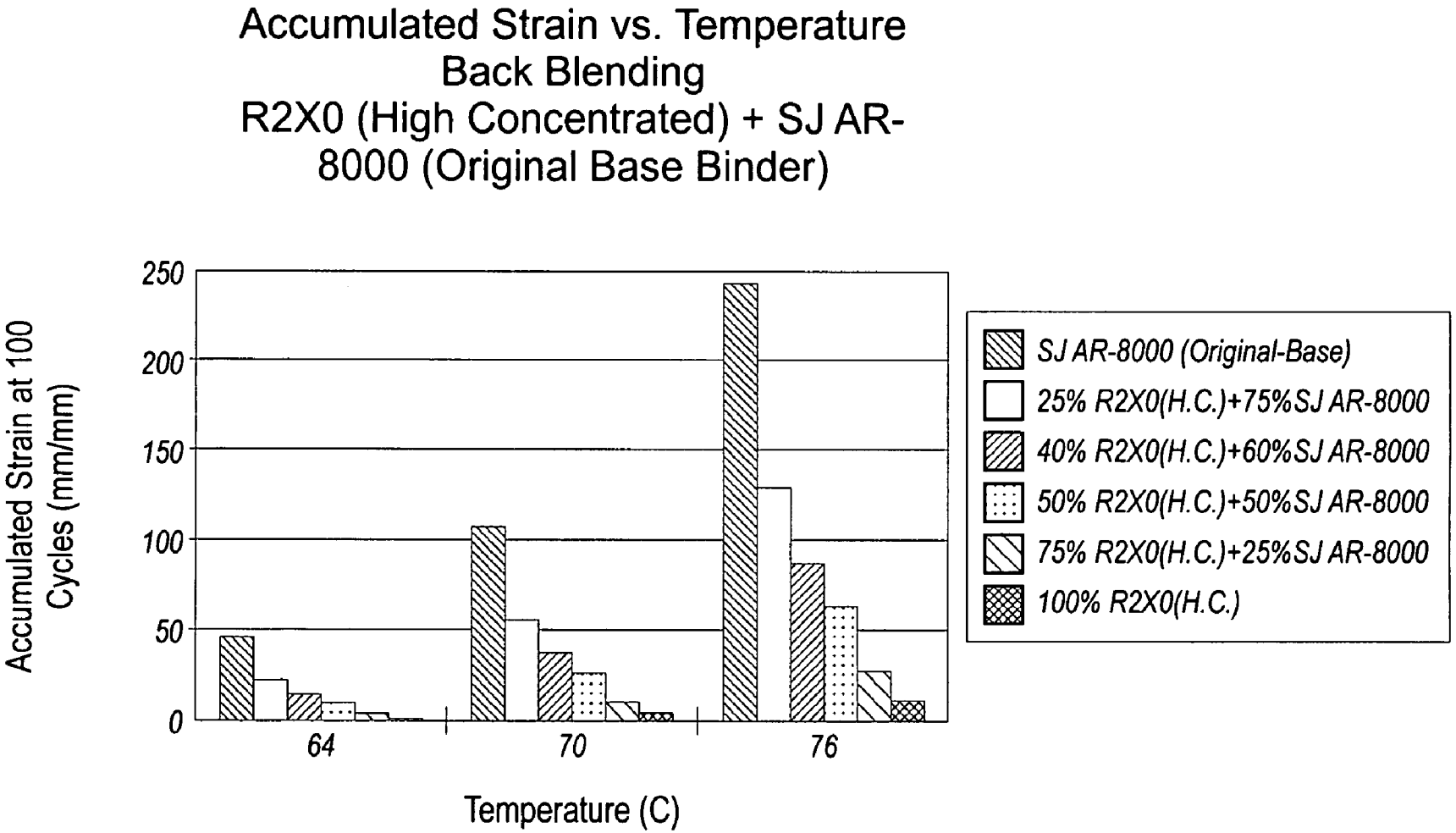
FIG. 5 shows a bar graph summarizing Creep and Recovery test results for a series of back-blended modified asphalts, demonstrating the degree to which the rutting resistance of the back-blended asphalts is improved as compared to the base asphalt.
Figure 6A:
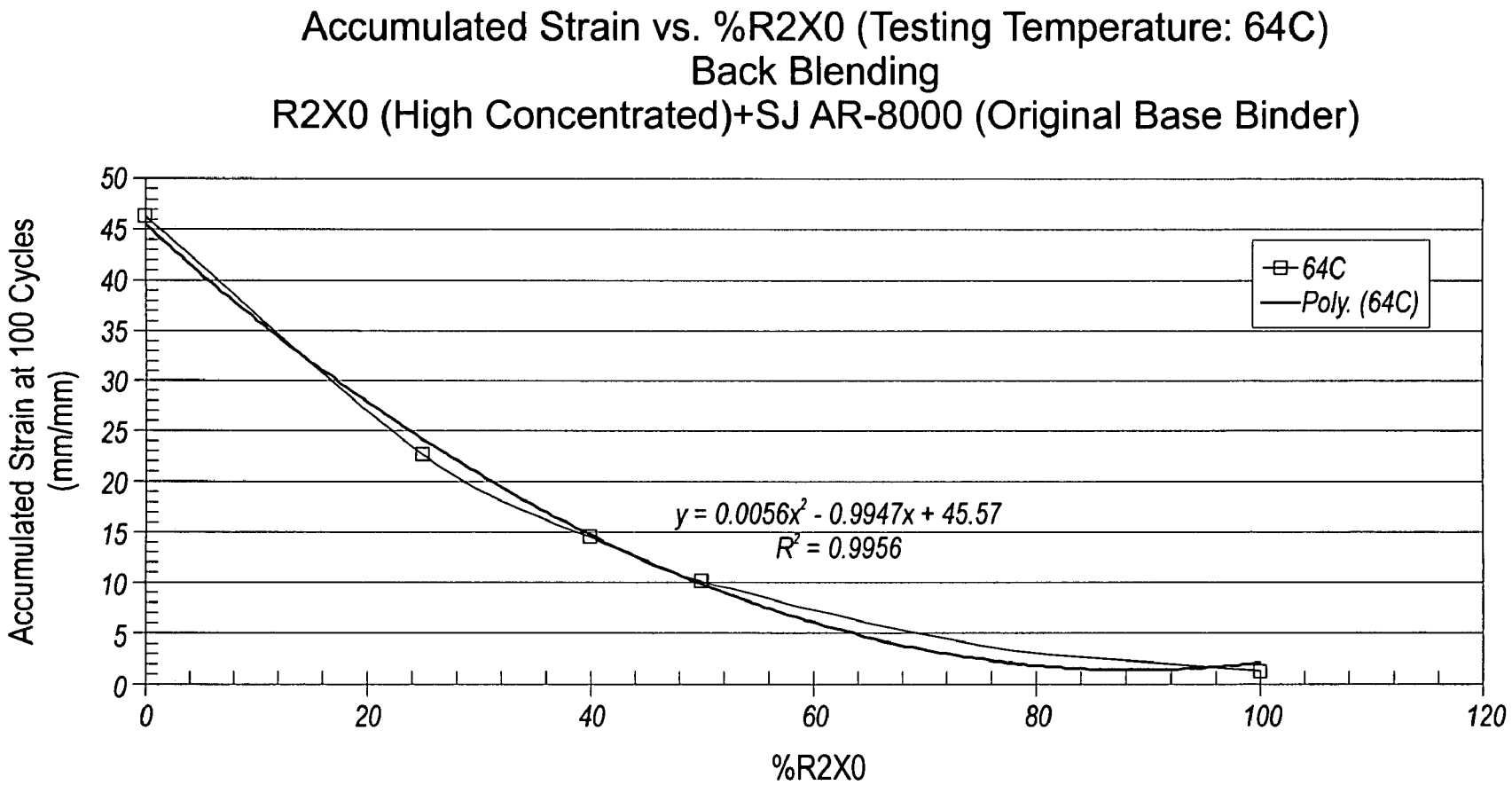
FIGS. 6A, 6B and 6C show line graphs summarizing Creep and Recovery test results for a series of back-blended modified asphalts, demonstrating the degree to which the rutting resistance of the back-blended asphalts is improved as compared to the base asphalt.
Figure 6B:
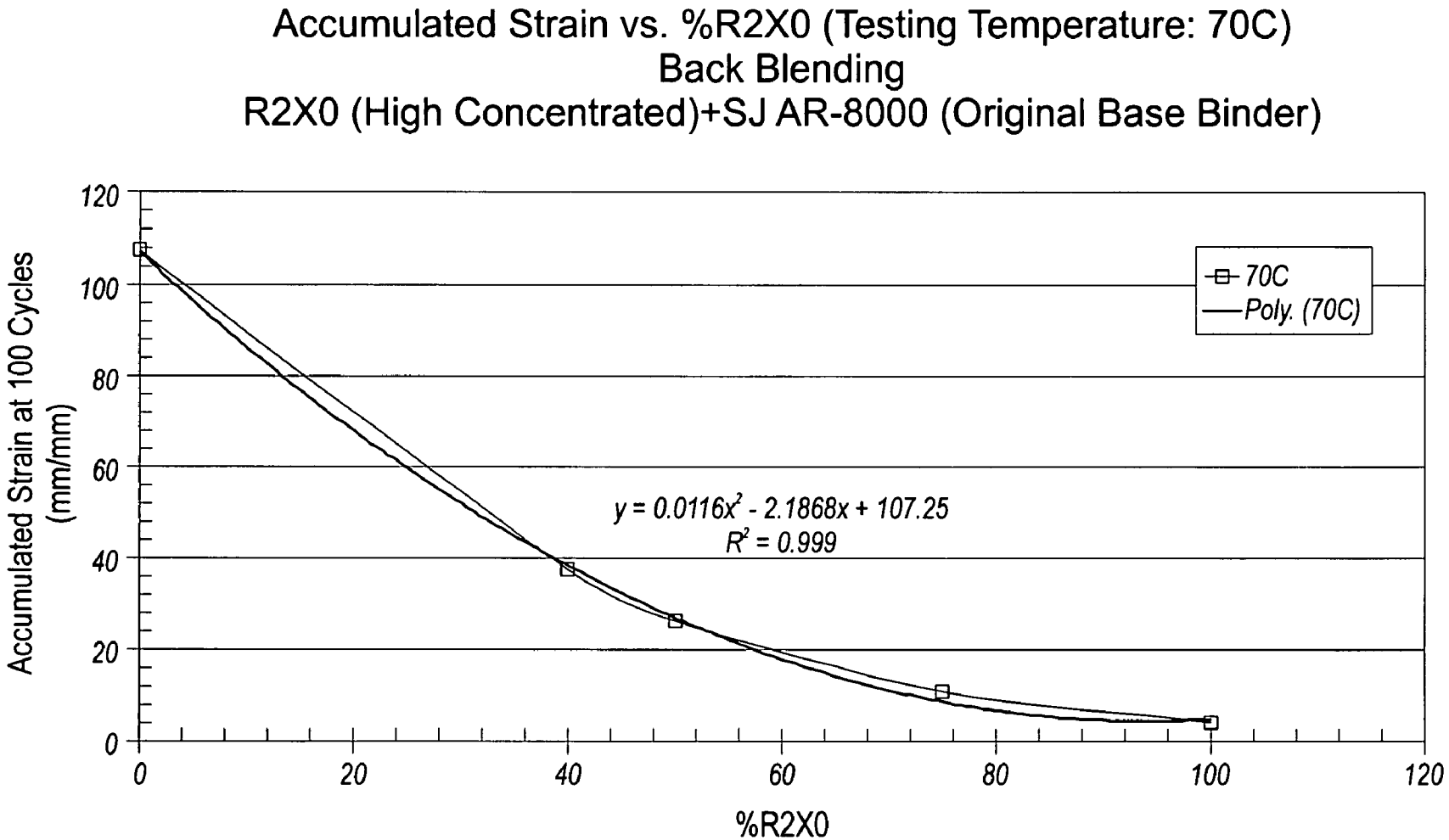
Figure 6C:
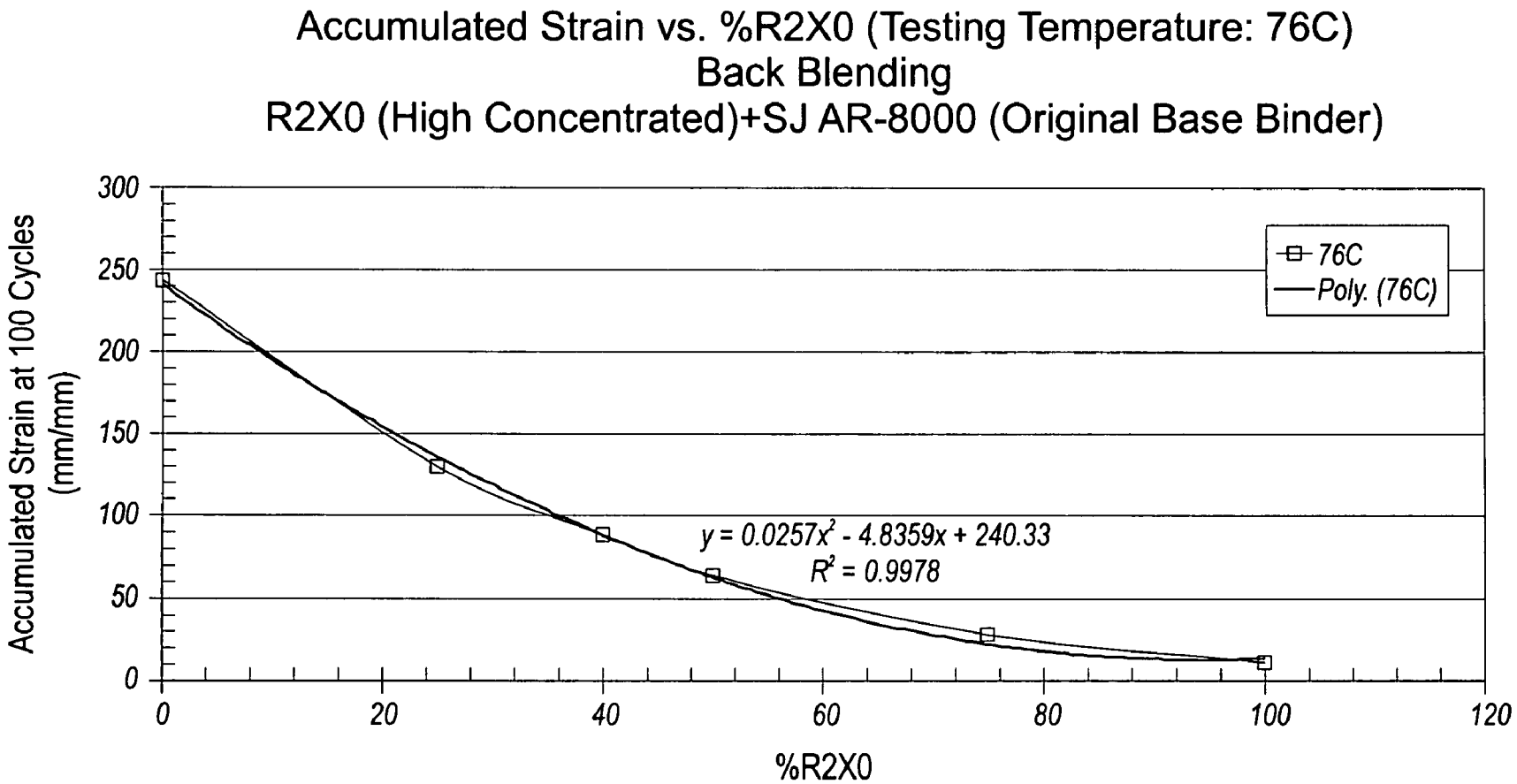

In an embodiment, a modified asphalt made as described herein (e.g., having at least two paving properties that are substantially improved as compared to the base asphalt from which it is made) may be blended with a second base asphalt to produce a second modified asphalt having at least one paving property that is substantially improved as compared to the second base asphalt. The second modified asphalt may be referred to herein as a back-blended asphalt. For example, as summarized in Table 2 below, a modified asphalt may be prepared that has as accumulated strain of about 11.2 mm/mm by blowing air through a base asphalt (having an accumulated strain of 46.4) at an elevated temperature of 400° C. at a high shear rate (produced by mixing at 10,000 rpm) for a treatment time of one hour. Such a modified asphalt (having an accumulated strain of about 11.2 mm/mm) may be back-blended with a second base asphalt in various ratios to produce a series of back-blended asphalts having a range of accumulated strain values as illustrated in FIGS. 5 and 6. It will be understood that the second base asphalt may be the same as, or different from, the base asphalt from which the modified asphalt is made. Thus, blending provides a way to produce a modified asphalt that has a particular value for a particular paving property, as illustrated by the range of accumulated strain values obtained by blending as illustrated in FIG. 4.

It will be understood that the second base asphalt may itself be a modified asphalt, and thus various batches of modified asphalts may be blended with one another. It will also be understood that three or more asphalts, at least one of which is a modified asphalt, may be blended together. Such blending may be carried out for various reasons, e.g., to produce a modified asphalt having a particular value for a particular paving property. Blending of a modified asphalt with a second base asphalt to produce a back-blended asphalt may be carried out using ordinary asphalt mixing equipment known to those skilled in the art, and the amounts of modified asphalt in the back-blended asphalt may be varied over a broad range, e.g., from about 0.1% to about 99.9%.

Blowing of the oxygen-containing gas through the base asphalt at a high gas flow rate may be conducted in various ways known to those skilled in the art of asphalt air-blowing. For example, the base asphalt may be placed into a container that comprises a source for an oxygen-containing gas. The source may be the outlet of a metal tube that is operably connected to an air pump configured to pump air into the tube at a high air flow rate. The tube is preferably configured within the container so that the outlet of the tube is beneath the surface of the base asphalt during treatment, so that the oxygen-containing gas bubbles through the asphalt during agitation at a high shear rate and heating. In an embodiment, agitation is supplied by an in-line mixer. The oxygen-containing gas may be introduced to the base asphalt binder prior to entry of the base asphalt binder to the in-line mixer, and/or the oxygen-containing gas may be introduced to the base asphalt within the in-line mixer. Various other configurations may also be used.

The level of oxygen in the oxygen-containing gas may vary over a broad range, e.g., from about 1% to about 100% by volume, based on total gas volume. The oxygen-containing gas may comprise various additional gases such as nitrogen, argon, and/or carbon dioxide. Preferably, the oxygen-containing gas comprises air. The oxygen-containing gas is preferably blown into the base asphalt at a high gas flow rate that depends on the level of oxygen in the gas. For air (oxygen content about 20%), the high gas flow rate for an asphalt sample size of about 3.5 kg is preferably greater than about 0.1 liters of air per kilogram of asphalt per minute (L/kg-min), more preferably greater than about 0.25 L/kg-min, even more preferably greater than about 0.5 L/kg-min. The oxygen content of the oxygen-containing gas and/or the high gas flow rate may be maintained at a particular level throughout the modification process, or each may be independently varied throughout the process.

The high gas flow rate of the oxygen-containing gas is preferably selected in conjunction with the high shear rate, the elevated temperature and the treatment time to substantially improve at least two paving properties of the base asphalt. More preferably, the high gas flow rate is selected in conjunction with the high shear rate, the elevated temperature and the treatment time to substantially improve both the rutting resistance and the fatigue resistance of the modified asphalt as compared to the base asphalt. Appropriate high gas flow rates for making particular modified asphalts may be selected by one skilled in the art by conducting routine experimentation in light of the guidance provided herein.

The base asphalt is at an elevated temperature while the oxygen-containing gas is blown through the base asphalt at a high gas flow rate and while simultaneously agitating the base asphalt at a high shear rate. The elevated temperature may be achieved by applying external heating to the container holding the base asphalt binder, or the elevated temperature may be achieved without external heating. For example, it has been found that elevated temperatures may be achieved simply by air-blowing at high air flow rates and simultaneously agitating at high shear rates. This invention is not bound by theory, but it is believed that the achievement of such elevated temperatures in the absence of external heating may result from the exothermic nature of a chemical reaction between the oxygen-containing gas and the base asphalt binder, and/or may result from the energy supplied to the base asphalt binder by the mechanical agitation. Thus, in various embodiments, the elevated temperature may be maintained within a desired range by external heating, by controlling the flow rate of the oxygen-containing gas, by controlling the shear rate, and/or by applying external cooling.

The elevated temperature is preferably selected in conjunction with the high gas flow rate, the high shear rate and the treatment time to substantially improve at least two paving properties of the base asphalt. More preferably, the elevated temperature is selected in conjunction with the high gas flow rate, the high shear rate, and the treatment time to substantially improve both the rutting resistance and the fatigue resistance of the modified asphalt as compared to the base asphalt. Appropriate elevated temperatures for making particular modified asphalts may be selected by one skilled in the art by conducting routine experimentation in light of the guidance provided herein. The elevated temperature for carrying out the methods described herein is typically in the range of about 100° C. to about 300° C., preferably in the range of about 120° C. to about 300° C., more preferably in the range of about 120° C. to about 250° C., even more preferably in the range of about 120° C. to about 200° C., most preferably in the range of about 160° C. to about 200° C. The elevated temperature may be maintained at a particular level or within a particular range throughout the modification process, or may be varied throughout the process.

The base asphalt is agitated at a high shear rate at an elevated temperature while the oxygen-containing gas is blown through the base asphalt at a high gas flow rate and while simultaneously maintaining the base asphalt at an elevated temperature. The high shear rate may be applied to the base asphalt in various ways. For example, the base asphalt may be placed into a container such as an in-line mixer (e.g., a commercially available Siefer Trigonal in-line mixer) or a reactor that is equipped with a suitable mechanical stirring device. For example, in an embodiment, the mechanical stirring device comprises a shaft equipped with a set of paddles or blades that are inserted into the container such that they are positioned to rotate beneath the surface of the base asphalt during operation. The mechanical stirring device further comprises a motor operably attached to the shaft and configured to turn the shaft at a relatively high rate of speed, thereby applying high shear to the base asphalt within the container during operation. Such mechanical stirring devices are commercially available from a variety of sources. For laboratory scale mixing, e.g., for a base asphalt sample size of about 3.5 kg in a reactor having a volume of about 6 liters (L), a variable speed Ross Model 100LCI High Shear Mixer (commercially available from Charles Ross and Son Company, New York) having a 1.0 horsepower (hp) motor is suitable. The Ross Model 100LCI High Shear Mixer, when used to apply high shear to a base asphalt having a sample size of about 3.5 kg in a reactor having a volume of about 6 liters, is preferably operated at a shear rate of about 2,000 rpm or greater, more preferably about 5,000 rpm or greater, most preferably about 10,000 rpm or greater, as described in the Examples below. In such a configuration the Ross Model 100LCI High Shear Mixer applies a shear rate to the base asphalt of about 2.8 million $sec^{-1}$ at 10,000 rpm. The reactor holding the base asphalt during the high shear is also preferably equipped with a temperature controlled jacket (configured to maintain the elevated temperature during agitation) and a source of oxygen-containing gas (configured to provide blowing of the oxygen-containing gas through the base asphalt during agitation).

Those skilled in the art will understand that the amount of shear energy applied to the base asphalt is related to manner in which the agitation is supplied and to the amount and viscosity of the asphalt. For the 3.5 kg AR-8000 asphalt modified in the 6 L configuration described in the Examples below, Table 1 below provides the approximate amount of shear power (motor horsepower) applied to the asphalt by the Ross Model 100LCI High Shear Mixer at various mixer rotational speeds.

TABLE 1

| Speed (rpm) | Shearing Power (hp) |
|---|---|
| 2,000 | 0.03 |
| 5,000 | 0.12 |
| 10,000 | 0.7 |

The high shear rate is preferably is preferably selected in conjunction with the high gas flow rate of the oxygen-containing gas, the elevated temperature and the treatment time to substantially improve at least two paving properties of the base asphalt. More preferably, the high shear rate is selected in conjunction with the high gas flow rate, the elevated temperature and the treatment time to substantially improve both the rutting resistance and the fatigue resistance of the modified asphalt as compared to the base asphalt. Appropriate high shear rates for making particular modified asphalts may be selected by one skilled in the art by conducting routine experimentation in light of the guidance provided herein.

Figure 8:
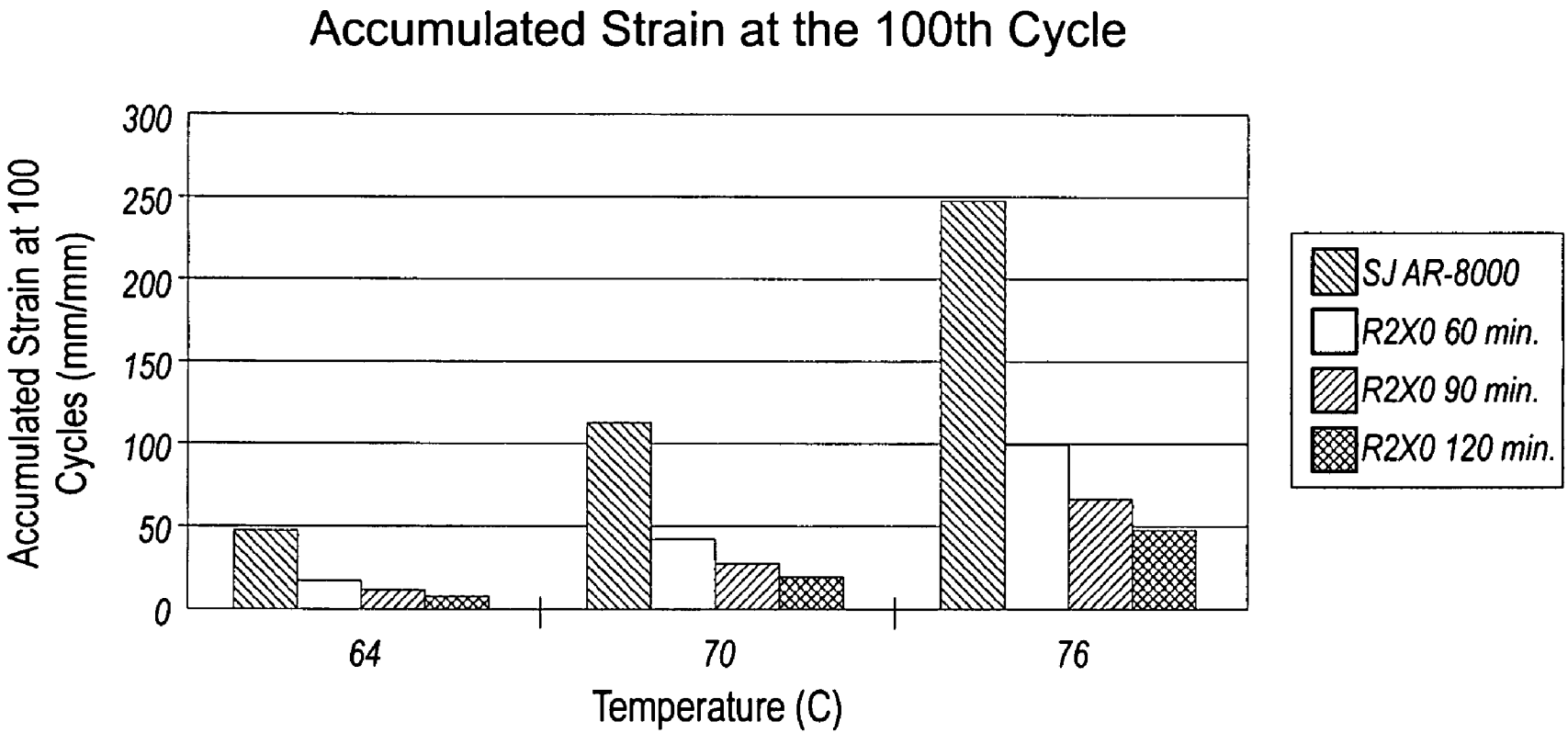
FIG. 8 shows a bar graph summarizing Creep and Recovery test results for a series of modified asphalts, demonstrating the effect of treatment time on rutting resistance.
Figure 9:
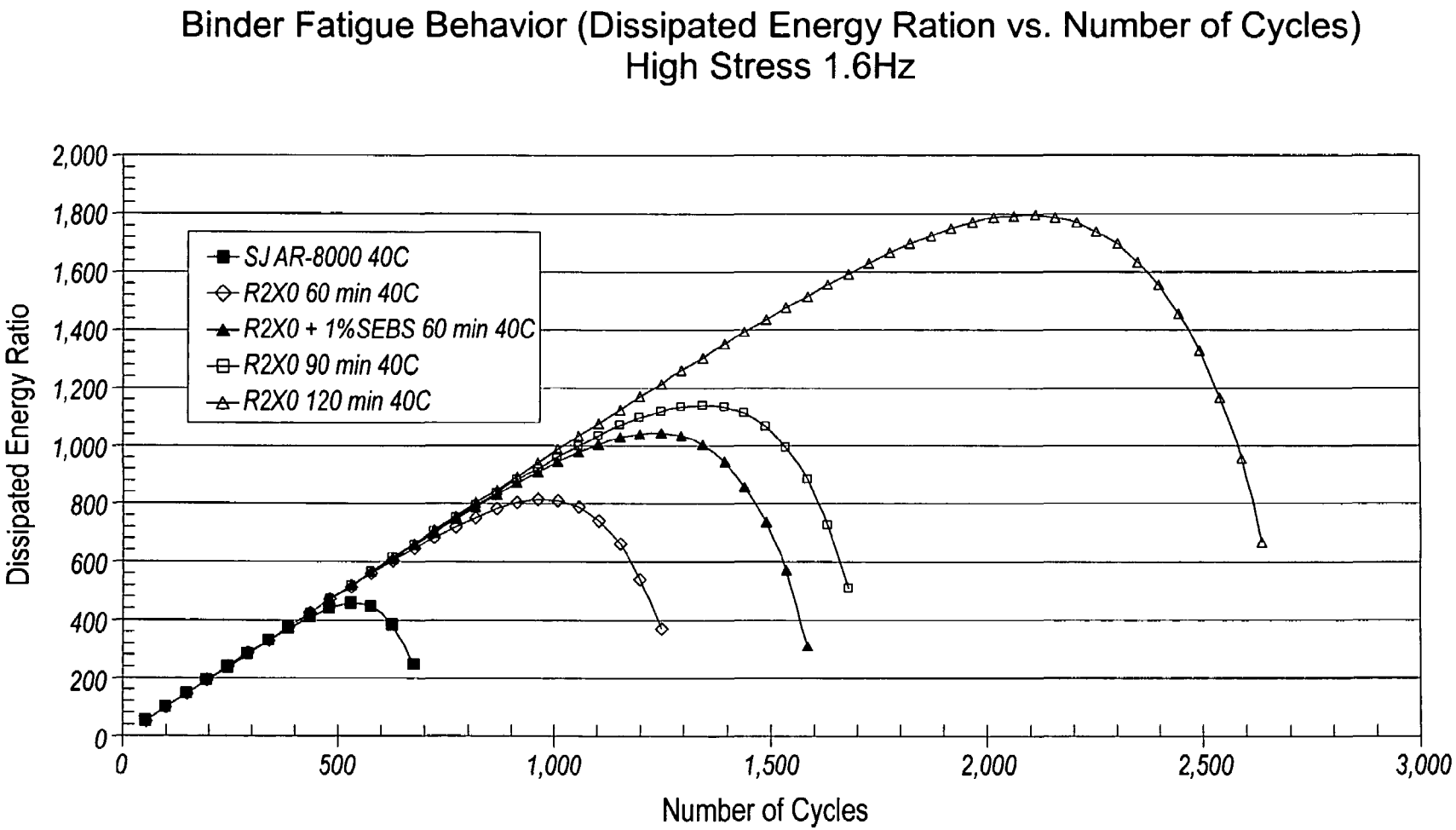
FIG. 9 shows plots of DER values obtained as a function the number of cycles to failure for a series of modified asphalts, demonstrating the effect of treatment time on fatigue resistance.

The treatment time, during which the base asphalt is modified by blowing an oxygen-containing gas through the base asphalt at a high gas flow rate while simultaneously agitating the base asphalt at a high shear rate and at an elevated temperature, may be varied over a broad range. In an embodiment, the treatment time is in the range of about 20 minutes to about 5 hours. A mixing time of about 60 minutes was used to obtain the data shown in Table 1. Some effects of varying the treatment time are illustrated in FIGS. 8-9. The treatment time is preferably is preferably selected in conjunction with the high gas flow rate of the oxygen-containing gas, the high shear rate and the elevated temperature to substantially improve at least two paving properties of the base asphalt. More preferably, the treatment time is selected in conjunction with the high gas flow rate, the high shear rate and the elevated temperature to substantially improve both the rutting resistance and the fatigue resistance of the modified asphalt as compared to the base asphalt. Appropriate treatment times for making particular modified asphalts may be selected by one skilled in the art by conducting routine experimentation in light of the guidance provided herein.

One skilled in the art may readily employ routine experimentation to scale-up the processes described herein by increasing or varying the type, manner and/or timing of agitating, heating and/or blowing of the oxygen-containing gas. Those skilled in the art will understand that such a scale-up may not be linear, e.g., a ten-fold increase in the amount of base asphalt to be modified does not necessarily require a ten-fold increase in process parameters such as the high gas flow rate, the high shear rate, the elevated temperature and the treatment time. Upon scale-up, however, those skilled in the art will be able to correlate process parameters determined on the scaled-up process with those on the smaller scale process.

For example, a scale-up may begin by selecting a target modified asphalt that is described in the Examples below, for which a particular asphalt modification process resulted in a particular level of substantial improvement in both the rutting resistance and the fatigue resistance for the target modified asphalt as compared to the base asphalt. The scale-up may then be continued by incrementally increasing the size of the base asphalt sample while using routine experimentation to incrementally adjust the high gas flow rate, the high shear rate, the elevated temperature and the treatment time to maintain the level of substantial improvement in both the rutting resistance and the fatigue resistance obtained in the target modified asphalt. It will be understood that, after the desired degree of scale-up in the size of the base asphalt is achieved, e.g., ten-fold, the modified asphalt produced by the resulting scaled-up process will have about the same level of substantial improvement in both the rutting resistance and the fatigue resistance as the target modified asphalt, both as compared to the base asphalt. Thereafter, the high gas flow rate, the high shear rate, the elevated temperature and the treatment time used for the scaled-up process may be correlated to those used to make the target modified asphalt.

Thus, those skilled in the art will understand that a correlation exists between the process parameters used to make a modified asphalt on any particular scale and the process parameters used to make a modified asphalt on a laboratory scale, and that routine experimentation may be used to determine the correlation. Therefore, one skilled in the art may readily determine by routine experimentation whether the process parameters used in any particular process for making a modified asphalt correspond to the process parameters described herein for making a modified asphalt.

For example, as noted above, for the 3.5 kg AR-8000 asphalt modified in the 6 L configuration described in the Examples below, Table 1 provides the approximate amount of shear power (motor horsepower) applied to the asphalt by the Ross Model 100LCI High Shear Mixer at various mixer rotational speeds. For any particular scaled-up process, one skilled in the art may readily determine a corresponding amount of power is supplied to the base asphalt using routine experimentation. For example, in a preferred embodiment, agitating the base asphalt at a high shear rate comprises supplying an amount of power to the base asphalt that corresponds to supplying at least about 0.01 horsepower of shearing power to a 3.5 kilogram sample of the base asphalt, more preferably at least about 0.02 horsepower of shearing power to a 3.5 kilogram sample of the base asphalt, per unit time period.

An embodiment provides a method for making a modified asphalt as described herein in which agitating the base asphalt at a high shear rate comprises supplying an amount of power to the base asphalt that corresponds to supplying at least about 0.03 horsepower of shearing power to a 3.5 kilogram sample of the base asphalt for about one hour. Another embodiment provides a method for making a modified asphalt as described herein in which agitating the base asphalt at a high shear rate comprises supplying an amount of power to the base asphalt that corresponds to supplying at least about 0.12 horsepower of shearing power to a 3.5 kilogram sample of the base asphalt for about one hour. Another embodiment provides a method for making a modified asphalt as described herein in which agitating the base asphalt at a high shear rate comprises supplying an amount of power to the base asphalt that corresponds to supplying at least about 0.7 horsepower of shearing power to a 3.5 kilogram sample of the base asphalt for about one hour. Another embodiment provides a method for making a modified asphalt as described herein in which agitating the base asphalt at a high shear rate comprises supplying an amount of power to the base asphalt that corresponds to supplying at least about 50 horsepower of shearing power, more preferably at least about 100 horsepower of shearing power, to a 5,000 gallon sample of the base asphalt for a treatment time in the range of about 30 minutes to about 5 hours.

Another embodiment provides a method for making a modified asphalt as described herein in which agitating the base asphalt at a high shear rate comprises supplying an amount of power to the base asphalt that corresponds to shearing a 3.5 kilogram sample at least about 2,000 rpm for about one hour. Another embodiment provides a method for making a modified asphalt as described herein in which agitating the base asphalt at a high shear rate comprises supplying an amount of power to the base asphalt that corresponds to shearing a 3.5 kilogram sample at least about 5,000 rpm for about one hour. Another embodiment provides a method for making a modified asphalt as described herein in which agitating the base asphalt at a high shear rate comprises supplying an amount of power to the base asphalt that corresponds to shearing a 3.5 kilogram sample at least about 10,000 rpm for about one hour.

Another embodiment provides a system for modifying asphalt, comprising a container for holding an asphalt binder, the container comprising a source for an oxygen-containing gas; a gas controller configured to introduce the oxygen-containing gas into the asphalt binder at a high gas flow rate, a mixer configured to agitate the base asphalt binder at a high shear rate; a temperature controller operably connected to the container and configured to control the temperature of the asphalt binder; and a system controller configured to control at least one of the gas controller, the mixer, and the temperature controller.

Figure 10:
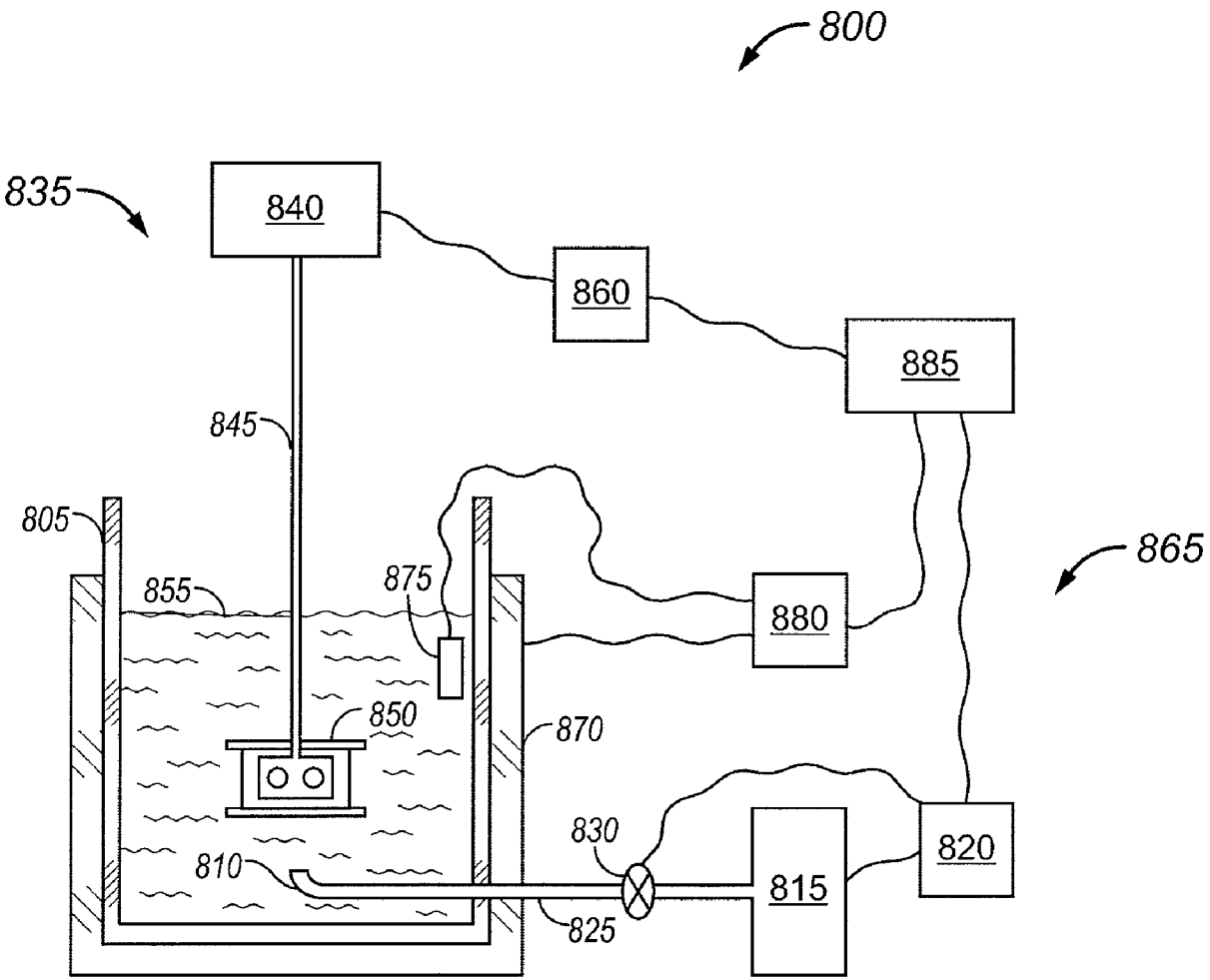
FIG. 10 schematically illustrates a system for modifying asphalt.

FIG. 10 schematically illustrates an embodiment of such a system 800 for modifying asphalt. The container for holding the asphalt binder may be, e.g., a reaction vessel 805 (shown in cross-section in FIG. 10) or an in-line mixer (not shown). The source for the oxygen-containing gas may be, e.g., the outlet of a metal tube 810 that is operably connected to an air pump 815 configured to pump air into the tube 810 at a high air flow rate as described above. The air pump 815 may be equipped with a pump controller 820 configured to control the amount of air supplied to the metal tube 810, e.g., by controlling the output of the air pump 815 and/or by controlling the rate of air flow through an air line 825 connecting the metal tube 810 to the air pump 815 by controlling a valve 830 on the air line 825.

FIG. 10 illustrates that a mixer 835 configured to agitate the base asphalt binder at a high shear rate may comprise a motor 840 operably attached to a mechanical stirring device 845 inserted into the container 805. The mechanical stirring device 845 is equipped with a rotor/stator head 850 (shown in cross-section in FIG. 10) configured to agitate the base asphalt 855 at a high shear rate, or the mixer 835 may comprise an in-line mixer (not shown) such as a commercially available Siefer Trigonal in-line mixer. The mixer 835 also preferably comprises a mixer controller 860 configured to control the agitation rate.

In an embodiment, the mixer 835 is preferably configured to agitate the base asphalt 855 at a high shear rate that comprises supplying an amount of power to the base asphalt that corresponds to shearing a 3.5 kilogram sample at least about 2,000 rpm, more preferably at least about 5,000 rpm, even more preferably at least about 10,000 rpm. In another embodiment, the mixer 835 is preferably configured to agitate the base asphalt 855 at a high shear rate that comprises supplying an amount of power to the base asphalt that corresponds to supplying at least about 0.03 horsepower, more preferably at least about 0.12 horsepower, even more preferably at least about 0.7 horsepower of shearing power to a 3.5 kilogram sample of the base asphalt 855. In another embodiment, the mixer 835 is preferably configured to agitate the base asphalt 855 at a high shear rate that comprises supplying an amount of power to the base asphalt that corresponds to supplying at least about 50 horsepower of shearing power, more preferably at least about 100 horsepower of shearing power, to a 5,000 gallon sample of the base asphalt 855.

FIG. 10 illustrates a temperature controller 865 comprising a heater 870 applied to the exterior of the container 805, a temperature sensor 875 configured to sense the temperature of the base asphalt 855, and a temperature control unit 880 operably attached to the temperature sensor 875 and the heater 870. The temperature control unit 880 is configured (e.g., programmed) to take readings from the temperature sensor 875 and make appropriate adjustments to the heater 870.

FIG. 10 illustrates a system controller 885 configured to control the pump controller 820, the mixer controller 835 and the temperature controller 865. In the illustrated embodiment, the system controller is electrically connected to the pump controller 820, the mixer controller 860, and the temperature control unit 880. The system controller 885 preferably comprises a computer. The computer is preferably programmed to control at least one, more preferably at least two, of the gas flow rate, the shear rate and the temperature of the base asphalt. Those skilled in the art may readily determine the appropriate configuration and programming for the computer by routine experimentation. It will be understood that various parts of the system 800 may be integrated into single devices. For example, the system controller 885 may be appropriately programmed to carry out the functions of the pump controller 820, the mixer controller 860 and/or the temperature control unit 880.

Various additives may be incorporated into the modified asphalts and mixtures thereof described herein. Such additives may be intermixed at various stages of the process, e.g., one or more additives may be intermixed with the base asphalt, with the partially modified asphalt during the modification process, and/or with the modified asphalt after the modification process. For example, a base asphalt may contain various additives known to those skilled in the art including, e.g., one or more air-blowing catalysts such as ferric chloride ($FeCl_3$), ferrous chloride ($FeCl_2$), phosphorous pentoxide ($P_2O_5$), aluminum chloride ($AlCl_3$), boric acid, copper sulfate ($CuSO_x$), zinc chloride ($ZnCl_2$), phosphorous sesquesulfide ($P_4S_3$), phosphorous pentasulfide ($P_4S_5$), phytic acid ($C_6H_6O_6$ $(H_2PO_3)_6$), phosphoric acid ($H_3PO_4$) and sulfonic acid. The following patents are incorporated herein by reference and particularly for the purpose of describing air-blowing catalysts and methods of making air-blown asphalts using such catalysts: U.S. Pat. Nos. 1,782,186; 2,200,914; 2,375,117; 2,450,756; 3,126,329; 4,338,137; 4,440,579; and 4,456,523. Part or all of the additive may remain in the resulting modified asphalt. In some cases air-blowing catalysts are unnecessary or undesirable, and thus in an embodiment the base asphalt used for making a modified asphalt is substantially free of an air-blowing catalyst. As another example, various polymer modifiers (e.g., SBS, SBR, SEBS, crumb rubber) may be incorporated into the asphalt to improve other paving properties (e.g., elasticity/recoverability, low temperature properties), see, e.g., U.S. Pat. Nos. 5,342,866 and 5,336,705, both of which are hereby incorporated by reference and particularly for the purpose of describing polymers and methods of incorporating them into asphalts. Other additives known to those skilled in the art such as anti-stripping agents (e.g., lime to improve moisture susceptibility of asphalt) may also incorporated into the asphalt.

Those skilled in the art will understand that the modified asphalts and mixtures thereof described herein may be incorporated into various paving compositions in a manner similar to that of unmodified asphalts. Thus, an embodiment provides a paving composition that comprises a modified asphalt as described herein. Such paving compositions may be used in the construction of various paved structures such as roadways and walkways, which preferably enjoy improved tensile stress/strain properties, improved fatigue behavior (e.g., retardation of fatigue crack initiation and propagation), improved rutting (reduced accumulated strain), and/or longer lifetimes resulting from the incorporation of the modified asphalts described herein. The assessment and selection of a modified asphalt for incorporation into a pavement is preferably based on the criteria set forth in U.S. Provisional Patent Application No. 60/581,667, filed Jun. 22, 2004, which is hereby incorporated by reference in its entirety.

Examples 1-29

A base asphalt, San Joaquin AR-8000 (SJ AR-8000), was modified according to a 3×3×3 matrix of various combinations of 3 elevated mixing temperatures, 3 air-blowing rates, and 3 shear rates (mixing speed by high shear mixer) according to the asphalt modification procedure described below. Thus, a series of modified asphalts were made using three different elevated mixing temperatures (250° F., 325° F., and 400° F.), three different amounts of air-blowing (0, ~50%, and 100% of the 2 L/min. pump capacity), three different mixing speeds (2,000 rpm, 5,000 rpm, and 10,000 rpm), and a treatment time of one hour, as summarized in Table 2 below. The modified asphalts may be referred to generically as "R2X0" herein.

Asphalt Modification Procedure

A sample of AR-8000 base asphalt (about 3500 grams) is poured into a cylindrical container (capacity about 6 liters) and heated up to the mixing temperature. The mixing head of a variable speed (500 to 10,000 rpm capacity) Ross Model 100LCI High Shear Mixer with 1.0 horsepower motor is placed at the center of the cylindrical container and the asphalt sample is agitated at the selected shear rate. The mixing temperature of the sample is controlled using a heating element that is applied to the outside of the cylindrical container. In some cases a cooling system (a laboratory fan or controlled temperature water bath) is used to cool the container in order to maintain the sample at the selected mixing temperature, particularly at higher shear rates (e.g., 10,000 rpm). The container is equipped with a temperature probe that is connected to a digital controller, which is used to control the temperature inside the container to ±5° C. during by activating the heating element and cooling system. The container is also equipped with a stainless steel tube that is connected via tubing to a small air pump having a pumping capacity of about 2 L/min. During mixing at the selected shear rate and heating at the selected temperature, air is blown into the sample container through the stainless steel tube exiting within the base asphalt under the mixing head at the selected air-blowing rate (0, ~50%, or 100% of pump capacity).

Improved Paving Properties

Rutting resistance of the modified asphalts was evaluated by the Creep and Recovery test using a Dynamic Shear Rheometer (DSR, see AASHTO standard TP5) according to the testing procedure set forth in NCHRP 9-10 report 459. During this testing, the asphalts are subjected to a repeated sequence of shear loading and unloading at a constant shear stress (100 Pa) and at two different test temperatures (64° C. and 70° C.). The strain response as a function of time is measured. The total number of repeated cycles is selected to be 100 and the loading time is selected to be one second. The ratio between loading time and unloading time is set to be 1:9. Test results obtained from the DSR are analyzed using the Burgers or four-element model (a combination of a Kelvin model and a Maxwell model in series). The results of the testing are expressed in terms of an accumulated strain value after 100. Accumulated strain is directly related to permanent deformation, and thus is used as an indicator of potential rutting of the asphalts. A lower accumulated strain is an indicator for higher resistance to rutting.

Figure 2A:
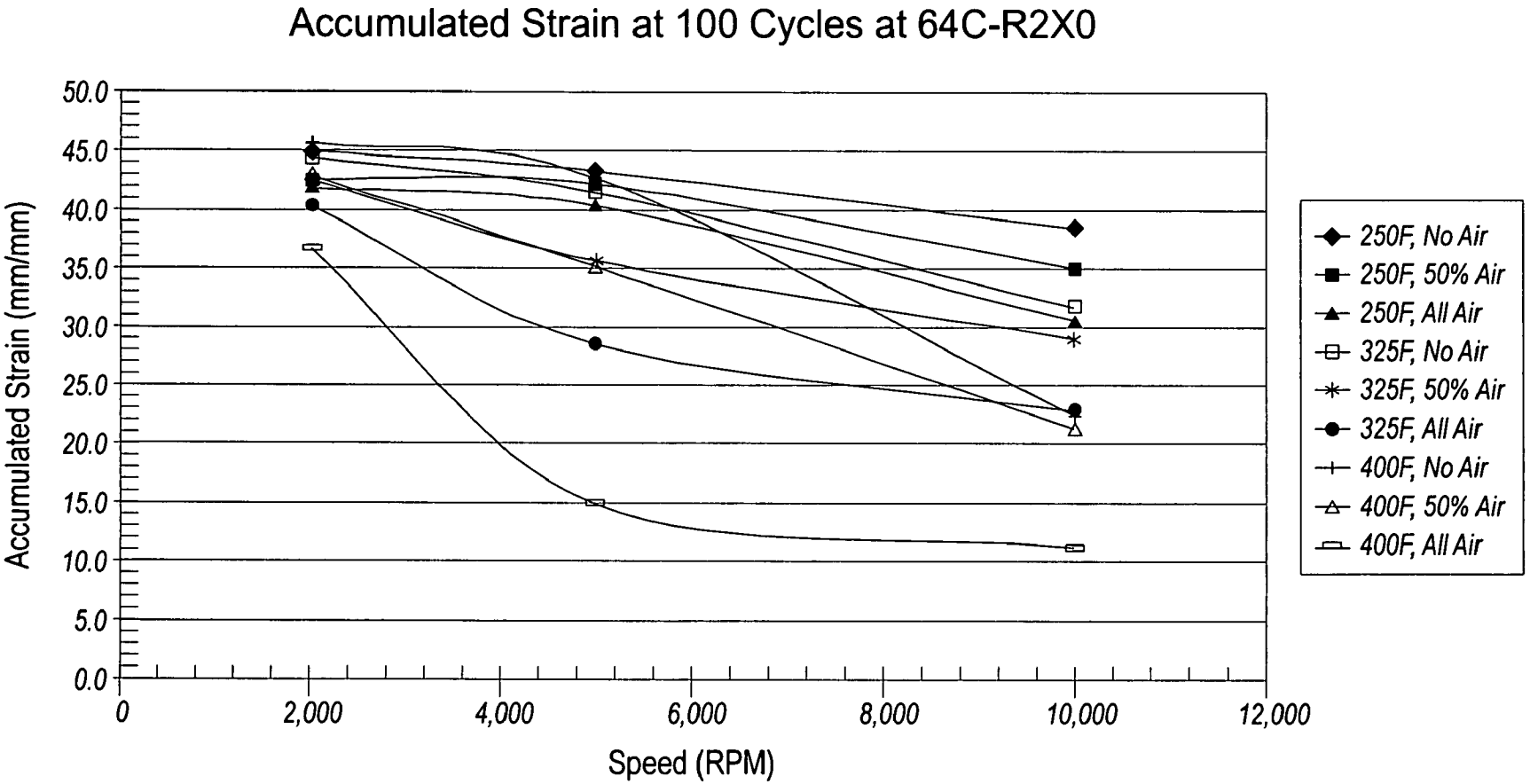
FIGS. 2A and 2B show line graphs summarizing Creep and Recovery test results for a series of modified asphalts, demonstrating the degree to which rutting resistance is improved by the various combinations of elevated temperature, air blowing and shear rate.
Figure 2B:
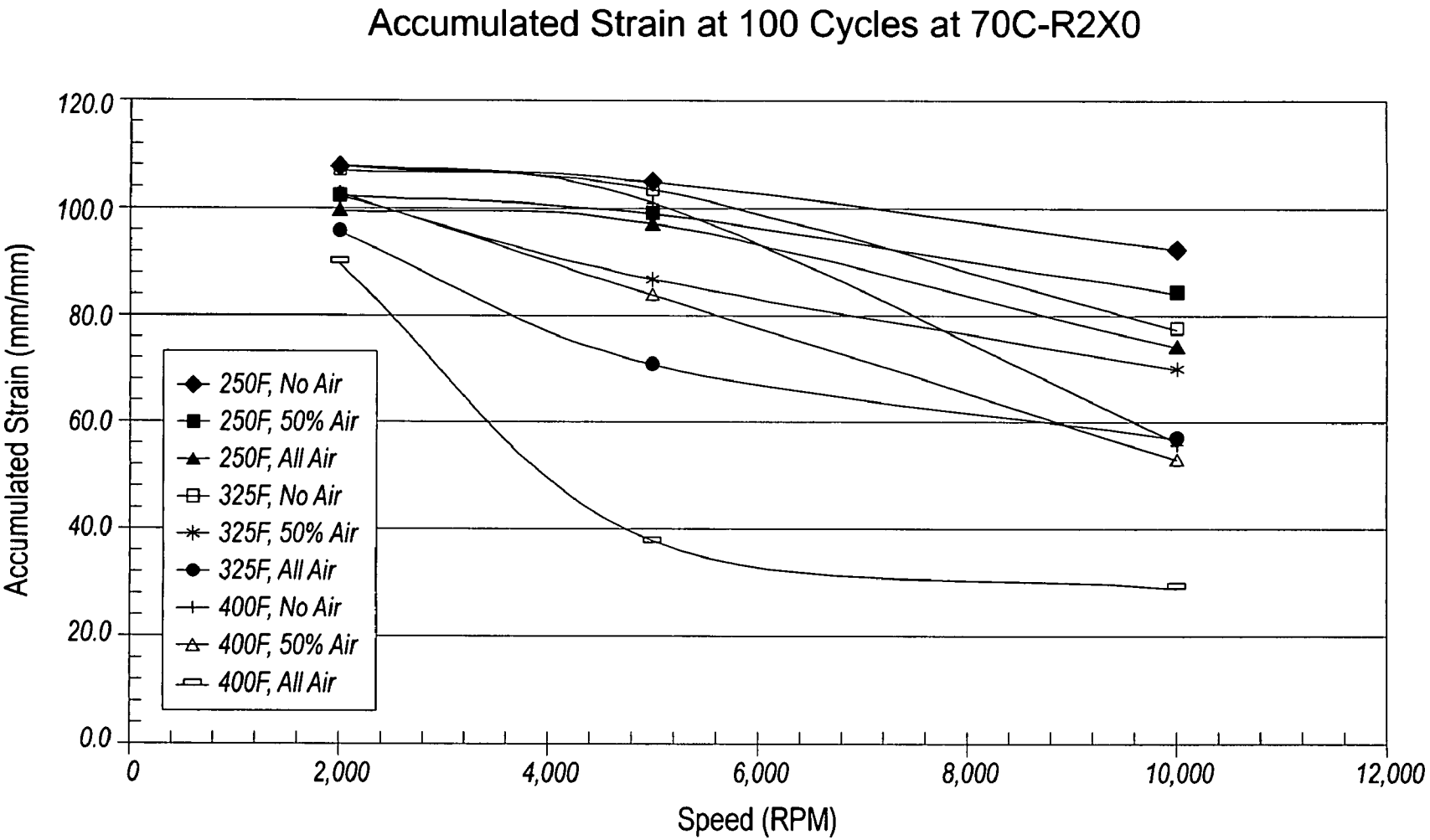

The accumulated strain values provided in Table 2 below and plotted in FIGS. 1 and 2 illustrate various combinations of high gas flow rate, high shear rate and elevated temperature for the selected treatment time (one hour) that result in a modified asphalt having substantially improved rutting resistance as compared to the base asphalt. For example, the accumulated strain value for the modified asphalt of Example 18 is about 22.8 mm/mm is about 49% of the accumulated strain of the base asphalt (about 46.4 mm/mm).

TABLE 2

Rutting Resistance (Creep and Recovery Testing)

| No. | Mixing Temp. (° F.) | Air Blowing (%) | Mixing Speed (rpm) | Accumulated Strain at 100 cycles (mm/mm) Test Temp. 64° C. | Test Temp. 70° C. | Brookfield Viscosity (cP) |
|---|---|---|---|---|---|---|
| 1C | 250 | 0 | 2000 | 43.3 | 103.5 | |
| 2C | 250 | 0 | 5000 | 41.7 | 99.8 | |
| 3C | 250 | 0 | 10000 | 38.5 | 92.6 | |
| 4 | 250 | 50 | 2000 | 42.6 | 102.7 | |
| 5 | 250 | 50 | 5000 | 42.2 | 99.1 | |
| 6 | 250 | 50 | 10000 | 35.0 | 84.1 | |
| 7 | 250 | 100 | 2000 | 41.8 | 99.5 | |
| 8 | 250 | 100 | 5000 | 40.4 | 97.1 | |
| 9 | 250 | 100 | 10000 | 30.6 | 74.0 | 401.3 |
| 10C | 325 | 0 | 2000 | 44.4 | 106.8 | |
| 11C | 325 | 0 | 5000 | 41.4 | 103.5 | |
| 12C | 325 | 0 | 10000 | 31.7 | 77.3 | 398.8 |
| 13 | 325 | 50 | 2000 | 42.5 | 102.1 | |
| 14 | 325 | 50 | 5000 | 35.7 | 86.9 | |
| 15 | 325 | 50 | 10000 | 28.9 | 70.0 | 433.8 |
| 16 | 325 | 100 | 2000 | 40.3 | 95.8 | 361.3 |
| 17 | 325 | 100 | 5000 | 28.4 | 70.7 | 431.3 |
| 18 | 325 | 100 | 10000 | 22.8 | 56.9 | 471.3 |
| 19C | 400 | 0 | 2000 | 45.7 | 107.8 | |
| 20C | 400 | 0 | 5000 | 42.6 | 101.1 | |
| 21C | 400 | 0 | 10000 | 22.4 | 56.3 | |
| 22 | 400 | 50 | 2000 | 42.9 | 102.9 | |
| 23 | 400 | 50 | 5000 | 35.2 | 83.8 | |
| 24 | 400 | 50 | 10000 | 21.3 | 53.1 | |
| 25 | 400 | 100 | 2000 | 36.8 | 89.9 | |
| 26 | 400 | 100 | 5000 | 14.9 | 38.0 | |
| 27 | 400 | 100 | 10000 | 11.2 | 29.0 | 696.3 |
| 28C | 325 | None ($N_2$) | 10000 | 37.9 | 92.3 | 373.8 |
| 29C | Base Asphalt | None | None | 43.2 | 107.6 | 348.8 |

C: Comparative

C: Comparative

Brookfield viscosities of the modified asphalts are measured in units of centipoise (cP) at 135° C. and 20 rpm rotational speed. The Brookfield viscosity results provided in Table 2 show that the viscosities of the modified asphalts are increased somewhat as compared to the base asphalt, but are still well below the 3,000 cP limit specified in MP1, demonstrating that the modified asphalt remains very workable after processing.

A modified asphalt is prepared by the general process described above for Examples 1-29, except that the treatment time is about 110-115 minutes, the air blowing is 100%, the mixing speed is increased from about 8,000 to about 10,000 rpm over the course of the treatment time, and the mixing temperature is increased from about 350° F. to about 410° F. over the course of the treatment time. The modified asphalt is then aged by Rolling Thin Film Oven (RTFO, AASHTO Standard T240 and ASTM D-2872) and then aged by PAV (AASHTO Standard PP1, ASTM D-454 and ASTM D-572). The fatigue resistance of the resulting modified asphalt was evaluated by the Repeated Cyclic Loading (RCL) test using a Dynamic Shear Rheometer according to the testing procedure set forth in NCHRP 9-10 report 459. The testing was conducted at two different frequencies (1.6 Hz and 10 Hz) to simulate traffic speed, two different intermediate temperatures (34° C. and 40° C.) to simulate climate conditions, and two different stress levels, high stress (HS, which represents weak or thin pavement), and low stress (LS, which represents strong or thick pavement) to simulate pavement structure. Asphalt samples are subjected to a repeated sequence of cyclic shear loading under constant stress. An amplitude sweep test is run on the asphalts in order to obtain the starting stress levels for the fatigue tests. The complex modulus, G*, and phase angle, δ, are measured as functions of the number of loading cycles over time. The cyclic loading is applied to the asphalt sample until fatigue failure occurs, which is defined in this testing as a 50% reduction in initial stiffness as measured by the DSR. The test data is analyzed using the concept of Dissipated Energy Ratio (DER) and $N_p$, the number of cycles to crack propagation which is defined as the intersection between the visco-elastic damping asymptote and the irrecoverable fatigue asymptote. The energy dissipated per cycle is calculated by the following equation:

$$w_i = \pi \sigma_i \epsilon_i \sin \delta \quad (1)$$

where $w_i$=the dissipated energy per cycle, $\sigma_i$=the stress amplitude at cycle i, $\epsilon_i$=the strain amplitude at cycle i, and δ=the phase angle between the stress and strain signals. The cumulative DER is calculated as follows:

$$DER = \frac{\sum_{i=1}^{n} W_i}{W_n} \quad (2)$$

where $w_i$=the dissipated energy at cycle i and $W_n$=the dissipated energy at cycle n.

Figure 3A:
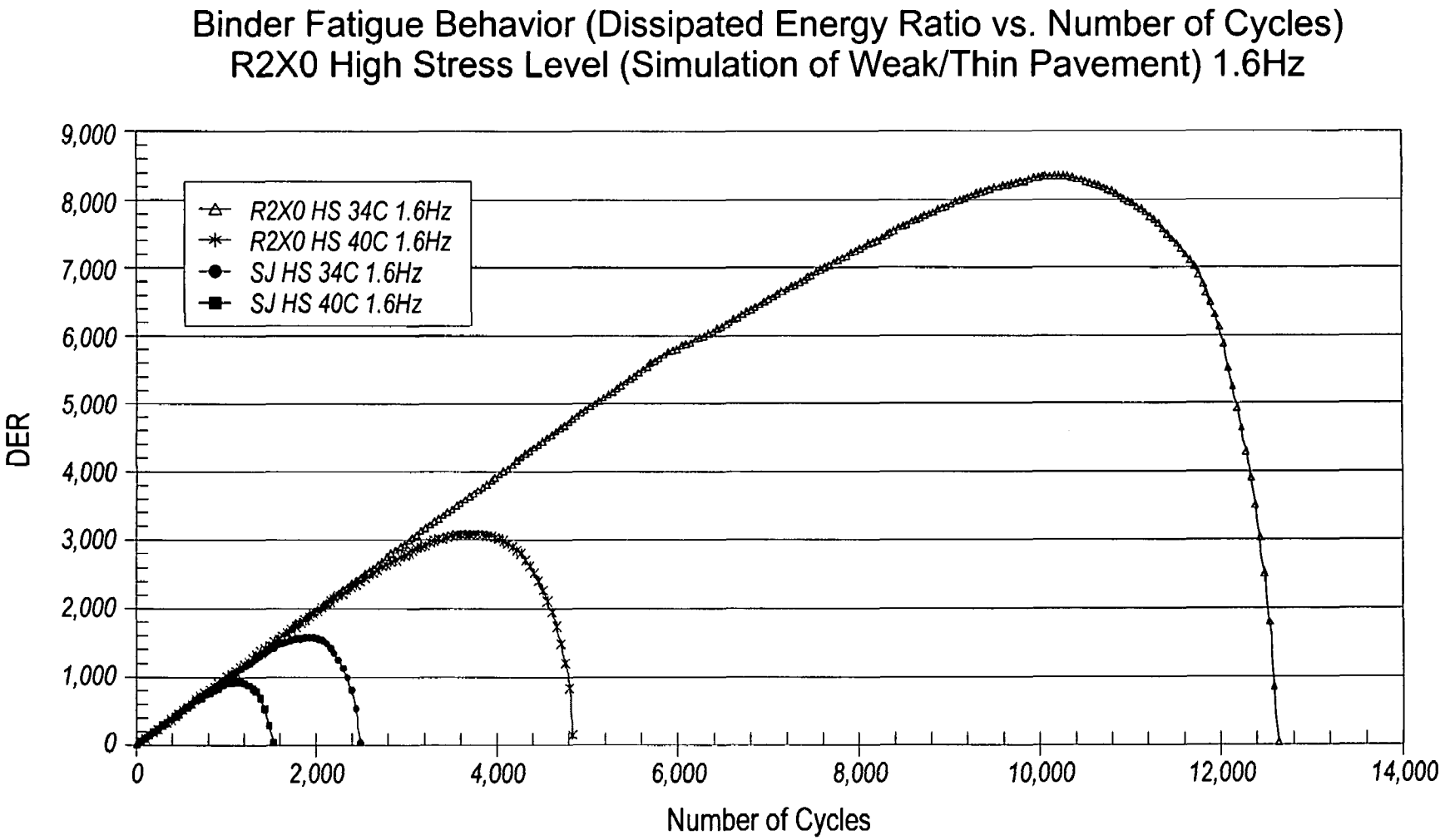
FIGS. 3A and 3B show plots of DER values obtained as a function the number of cycles to failure for a modified asphalt and the corresponding base asphalt, demonstrating the degree to which fatigue resistance is improved for the modified asphalt as compared to the base asphalt.
Figure 3B:
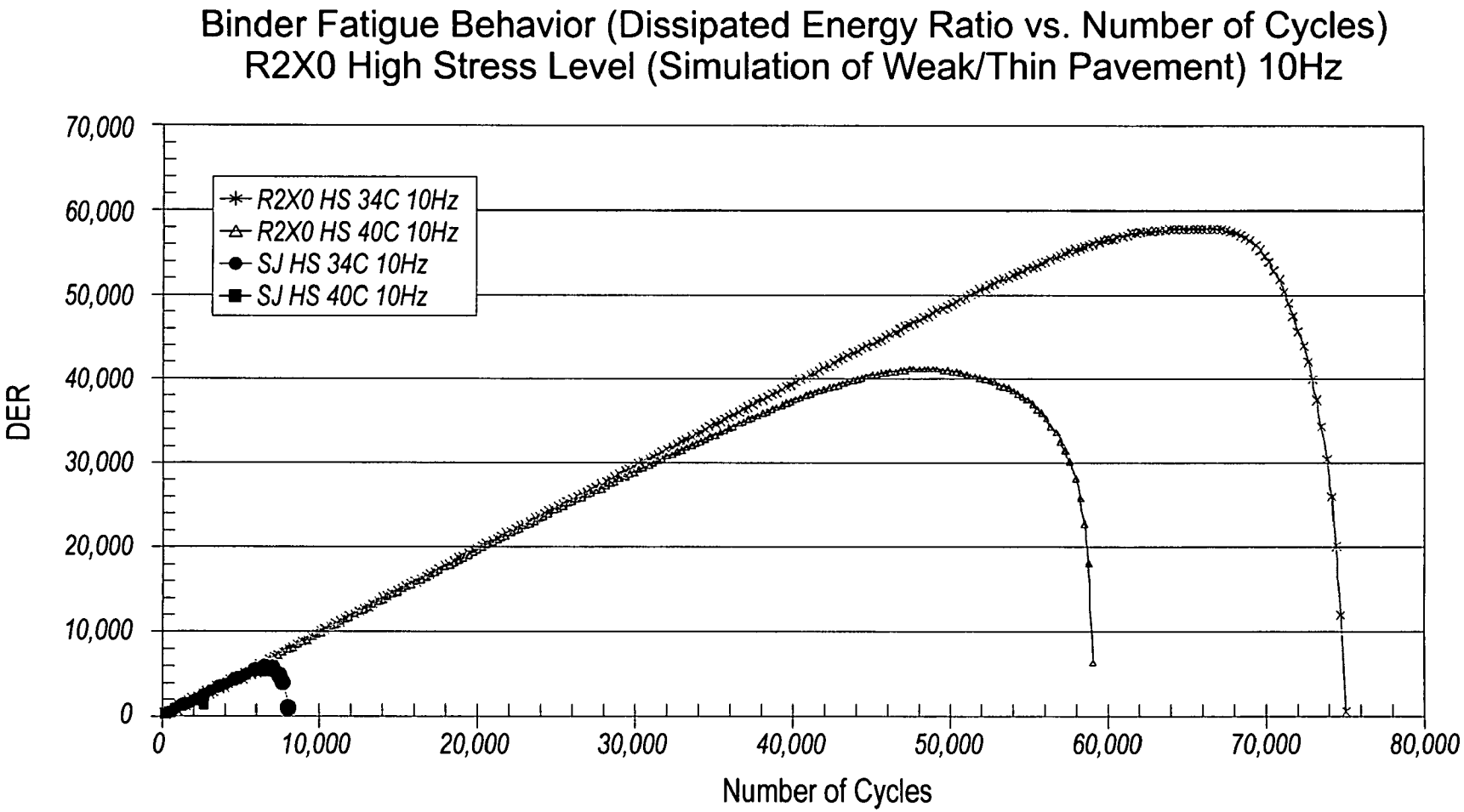

DER values obtained from RCL testing are plotted in FIGS. 3 and 4 as a function the number of cycles to failure. The plots demonstrate the degree to which the fatigue resistance of the modified asphalt (R2X0) is substantially improved as compared to the base asphalt binder ("SJ", AR-8000 from San Joaquin Refining). For example, FIG. 3A shows that the fatigue resistance for the modified asphalt (R2X0) tested at 40° C. (about 4800 cycles to failure) is about 3 times the fatigue resistance of the base asphalt (SJ) tested at the same temperature (about 1600 cycles to failure).

A number of other paving properties of modified asphalts were evaluated as summarized in U.S. Provisional Patent Application No. 60/581,667, filed Jun. 22, 2004. Those evaluations illustrate modified asphalts having substantially improved paving properties as compared to the base asphalts from which they are made, and are incorporated herein by reference.

Examples 30-31

The PG grading of a modified asphalt was evaluated in accordance with Superpave (Superior Performing Asphalt Pavements) asphalt binder specification (AASHTO MP1) as summarized in Tables 3-4 below. The results show that PG grading is improved two grades for the high temperature limit and one grade for the low temperature limit, thereby illustrating that PG grade is a paving property that may be substantially improved by the asphalt modification processes described herein.

TABLE 3

| Base Asphalt (San Joaquin Refining AR-8000) PG Grade: 64-4 | | | | |
|---|---|---|---|---|
| | Original (Un-aged) Binder | | RTFO Aged Residue | |
| Testing | Dynamic Shear Rheometer (DSR), 10 rad/s | | | |
| Temperature ° C. | Phase Angle, δ (deg) | G*/sinδ (kPa) (Min: 1.0 kPa) | Phase Angle (deg) | G*/sinδ (kPa) (Min: 2.2 kPa) |
| 64 | 89.5 | 2.591 | 88.7 | 4.848 |
| 70 | 89.9 | 1.082 | 89.4 | 2.003 |
| 76 | 89.9 | 0.503 | | |

| PAV Aged Binder (Aging temperature: 100° C.) | | | | | |
|---|---|---|---|---|---|
| | | | Bending Beam Rheometer Flexural Creep, 60 seconds | | |
| Testing | DSR, 10 rad/s | | Stiffness | | |
| Temperature ° C. | Phase Angle, δ (deg) | G*x sinδ (kPa) (Max: 5 MPa) | Testing Temp. ° C. | (Mpa) (Max: 300) | m-value (Min: 0.3) |
| 34 | 66.8 | 3850 | 6 | | |
| 31 | 62.3 | 6750 | 0 | 279 | 0.311 |
| 28 | 57.4 | 10685 | −6 | 451 | 0.221 |

TABLE 4

| R2X0 (air-blown for about 105-110 min. at about 350-400° C. while shearing at about 10000 rpm) PG Grade: 76-10 | | | | |
|---|---|---|---|---|
| | Original (Un-aged) Binder | | RTFO Aged Residue | |
| Testing | Dynamic Shear Rheometer (DSR), 10 rad/s | | | |
| Temperature ° C. | Phase Angle, δ (deg) | G*/sinδ (kPa) (Min: 1.0 kPa) | Phase Angle (deg) | G*/sinδ (kPa) (Min: 2.2 kPa) |
| 76 | 88.6 | 1.945 | 87.7 | 3.358 |
| 82 | 89.3 | 0.894 | 88.7 | 1.588 |

| PAV Aged Binder (Aging temperature: 100° C.) | | | | | |
|---|---|---|---|---|---|
| | | | Bending Beam Rheometer Flexural Creep, 60 seconds | | |
| Testing | DSR, 10 rad/s | | Stiffness | | |
| Temperature ° C. | Phase Angle, δ (deg) | G*x sinδ (kPa) (Max: 5 MPa) | Testing Temp. ° C. | (Mpa) (Max: 300) | m-value (Min: 0.3) |
| 37 | 58.7 | 4908 | 0 | 269 | 0.355 |
| 34 | 54.7 | 7698 | | | |

Examples 32-37

A modified asphalt is prepared by the general process described above for Examples 1-29, except that the base asphalt sample size is about 1,600 grams, mixing is conducted in a one-gallon container, the treatment time is about 60 minutes, the mixing speed is increased from about 8,000 to about 10,000 rpm over the course of the treatment time, and the mixing temperature is increased from about 300° F. to about 400° F. over the course of the treatment time. During mixing, air-blowing is conducted by forming a vortex during shear. A series of "back-blended" modified asphalts were made by mixing samples of this modified asphalt with samples of base asphalt (AR-8000 from San Joaquin Refining) in the ratios shown in Table 5 below. The mixing temperature for back blending is about 300° F. to about 325° F. and the mixing time for back blending is about 2 minutes to about 5 minutes.

The rutting resistance of the back-blended modified asphalts was evaluated by the Creep and Recovery test as described above for Examples 1-29, at three different testing temperatures (64° C., 70° C., and 76° C.). The resulting accumulated strain values are plotted in FIGS. 5 and 6. The data in FIGS. 5 and 6 illustrates various amounts of a modified asphalt (R2X0 H.C.=high concentrated) that may be blended with a base asphalt (SJ AR-8000) to produce a back-blended asphalt having improved rutting resistance as compared to the base asphalt.

TABLE 5

| Back-Blended Modified Asphalts | | |
|---|---|---|
| No. | Wt. % AR-8000 | Wt. % Modified Asphalt |
| 32C | 100 | 0 |
| 33 | 75 | 25 |
| 34 | 60 | 40 |
| 35 | 50 | 50 |
| 36 | 25 | 75 |
| 37 | 0 | 100 |

Examples 38-41

A modified asphalt is prepared by the general process described above for Examples 1-29, at a treatment time of about 300 minutes, air-blowing of 100%, a mixing speed of about 10,000 rpm, and a mixing temperature that is increased from about 350° F. to about 425° F. over the course of the treatment time. A series of "back-blended" modified asphalts were made by mixing a sample of this modified asphalt with a sample of base asphalt (AR-8000 from San Joaquin Refining) in the ratios shown in Table 6 below. The mixing temperature for back blending is about 300° F. to about 325° F. and the mixing time for back blending is about 2 minutes to about 5 minutes.

The PG grading of the modified asphalts was evaluated in accordance with Superpave asphalt binder specification (AASHTO MP1) in a manner similar to that described in Examples 30-31 above. The results shown in Table 6 demonstrate that PG grade is a paving property that may be improved by back-blending a modified asphalt with a base asphalt.

Figure 7A:
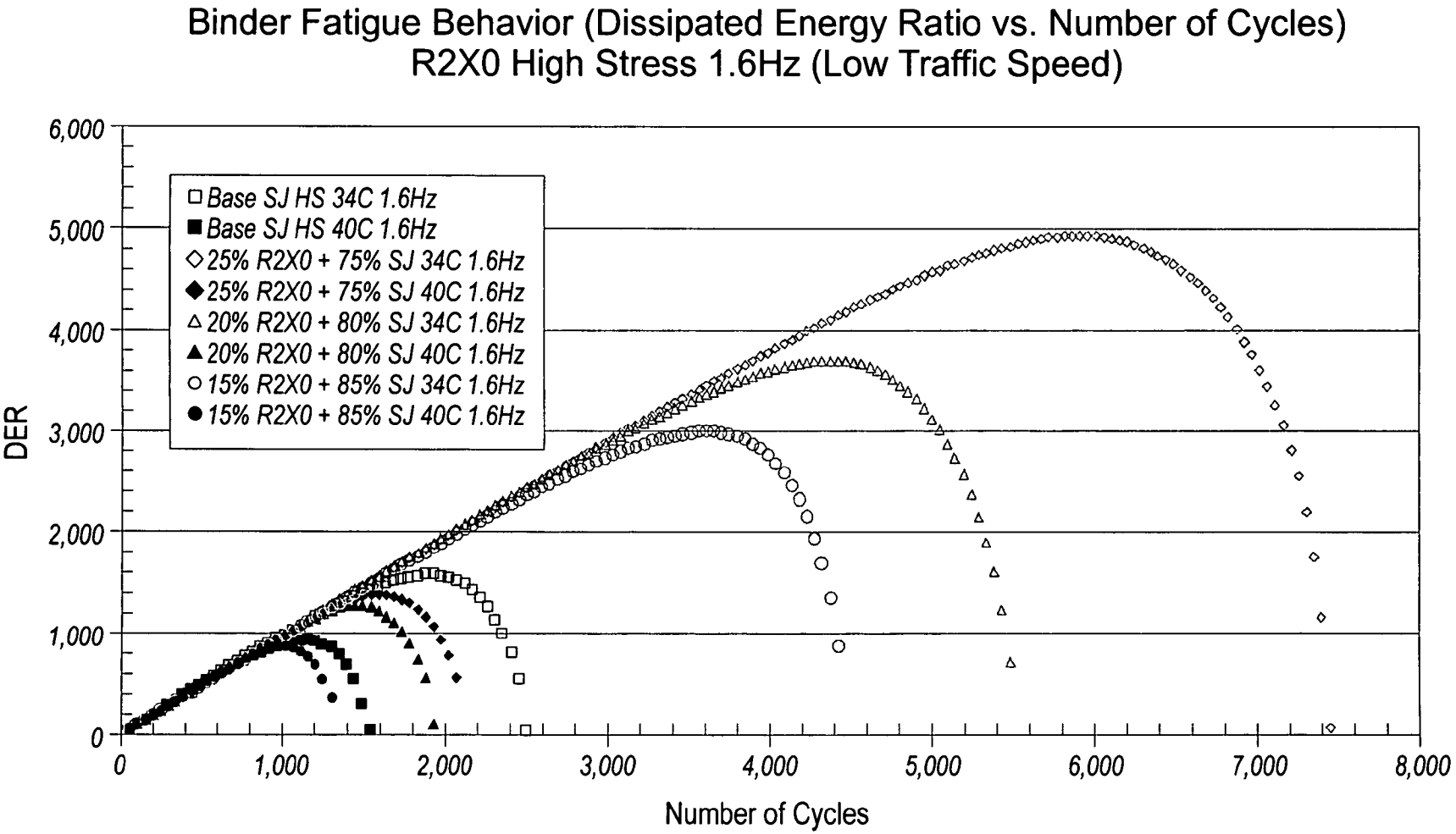
FIGS. 7A and 7B show plots of DER values obtained as a function the number of cycles to failure for a series of back-blended modified asphalts, demonstrating the degree to which fatigue resistance is improved for the back-blended modified asphalts as compared to the base asphalt.
Figure 7B:
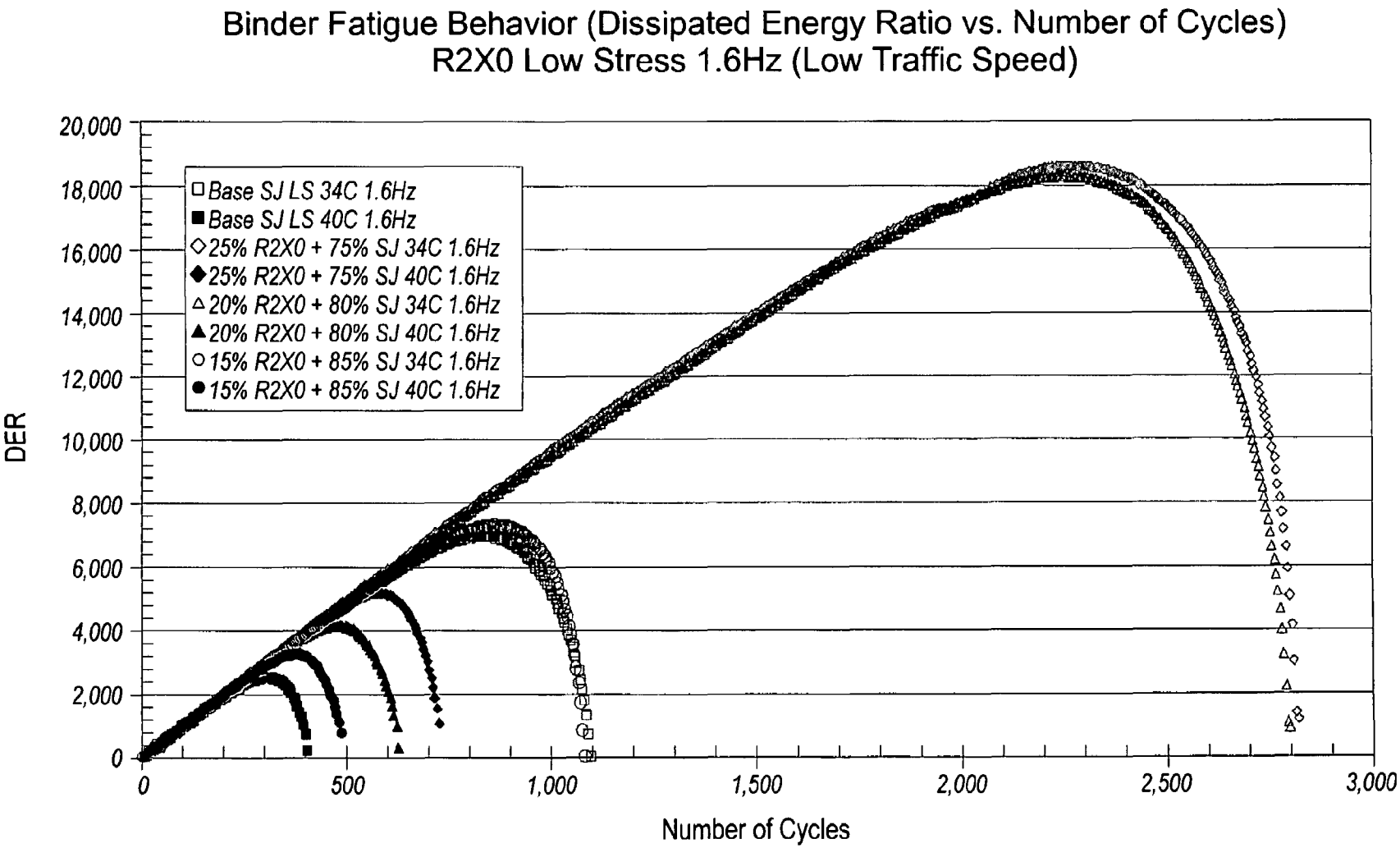

The back-blended modified asphalt is aged by Rolling Thin Film Oven (RTFO, AASHTO Standard T240 and ASTM D-2872) and then aged by PAV (AASHTO Standard PP1, ASTM D-454 and ASTM D-572). The fatigue resistance of the resulting back-blended modified asphalts was evaluated by the Repeated Cyclic Loading (RCL) test as described above for Examples 1-29, at 1.6 Hz, at Low Stress (LS) and at High Stress (HS), and at 34° C. and 40° C. DER values obtained from RCL testing are plotted in FIG. 7 as a function the number of cycles to failure. The plots demonstrate the degree to which the fatigue resistance of the back-blended modified asphalts is substantially improved as compared to the base asphalt binder ("SJ", AR-8000 from San Joaquin Refining). For example, FIG. 7A shows that the fatigue resistance for the back-blended asphalt containing 15% modified asphalt (R2X0) tested at 34° C. (about 4500 cycles to failure) is about 80% higher than the fatigue resistance of the base asphalt (SJ) tested at the same temperature (about 2500 cycles to failure).

TABLE 6

| Back-Blended Modified Asphalts | | | |
|---|---|---|---|
| No. | Wt. % AR-8000 | Wt. % Modified Asphalt | PG Grade |
| 38C | 100 | 0 | 64-4 |
| 39 | 85 | 15 | 70-4 |
| 40 | 80 | 20 | 70-4 |
| 41 | 75 | 25 | 76-10 |

Examples 42-45

A series of modified asphalts are prepared by the general process described above for Examples 1-29, except that three different treatment times (60 min. 90 min. and 120 min.) are selected. The air-blowing for all of the asphalt samples is 100%, the mixing speed is about 10,000 rpm, and the mixing temperature is increased from about 330° F. to about 400° F. over the course of the various treatment times. Creep and Recovery tests are conducted on the resulting modified asphalts as described above for Examples 1-29, at three different test temperatures (64° C., 70° C. and 76° C.). The resulting accumulated strain values are plotted in FIG. 8, which illustrates the effect of varying treatment time on the rutting resistance of the resulting modified asphalts.

Examples 46-50

A series of modified asphalts prepared as described in Examples 42-45 were aged by Rolling Thin Film Oven (RTFO, AASHTO Standard T240 and ASTM D-2872) and then aged by PAV (AASHTO Standard PP1, ASTM D-454 and ASTM D-572). Another modified asphalt was prepared by adding 1% SEBS polymer to a sample (3500 g) of the base asphalt and then treated by the modification process using a treatment time of 60 minutes. The air-blowing for this sample (R2X0+1% SEBS) was 100%, the mixing speed was about 10,000 rpm, and the mixing temperature was increased from about 330° F. to about 400° F. over the course of the treatment time. This sample was also aged by the RTFO and PAV as described above prior to fatigue testing. The fatigue resistance of the resulting aged modified asphalts was evaluated by the Repeated Cyclic Loading (RCL) test as described above for Examples 1-29, at 1.6 Hz, High Stress and at 40° C. DER values obtained from RCL testing are plotted in FIG. 9 as a function the number of cycles to failure. FIG. 9 illustrates the effect of varying treatment time on the fatigue resistance of the resulting modified asphalts.

It will be appreciated by those skilled in the art that various omissions, additions and variations may be made to the compositions and processes described above without departing from the scope of the invention, and all such modifications and changes are intended to fall within the scope of the invention, as defined by the appended claims.

The standards and test methods described below are hereby incorporated by reference.

AASHTO Standards

MP1: Specification for the Performance Graded asphalt binder.

MP1a (modified in 2000): Specification for the Performance Graded asphalt binder.

PP1: Practice for Accelerated Aging of asphalt binder using a Pressurized Aging Vessel (PAV).

PP6 (modified in 2000): Practice for grading or verifying the Performance Grade of asphalt binder.

TP1: Method for determining the Flexural Creep Stiffness of asphalt binder using the Bending Beam Rheometer (BBR).

TP5: Method for determining Rheological Properties of asphalt binder using a Dynamic Shear Rheometer (DSR).

TP48: Method for Viscosity Determination of asphalt binder using Rotational Viscometer.

T240 (modified in 2000): Effect of Heat and Air on a Moving Film of Asphalt (Rolling Thin Film Oven Test, RTFO).

Testing Methods According to NCHRP 9-10 (National Cooperative Highway Research Program) Report 459

Method for determining the Rutting Resistance of asphalt binder subjected to Repeated Creep (RC) using the DSR.

Method for determining the Fatigue life of asphalt binder subjected to Repeated Cyclic Loading (RCL) using the DSR.

Rotational Viscosity to measure workability of the binders by using Brookfield Viscometer.

Creep and Recovery Test (rutting measurements) at two different high pavement temperatures, 70° C. and 64° C. using a Dynamic Shear Rheometer (DSR).

Amplitude Sweep Test at two different intermediate pavement temperatures, 34° C. and 40° C., and two different frequencies, 1.6 Hz and 10 Hz, using the DSR for the PAV (Pressure Aging Vessel) aged binders.

Fatigue Test subjected to Repeated Cyclic Loading (RCL) at two different intermediate pavement temperatures (34° C. and 40° C.), two different frequencies (1.6 Hz and 10 Hz), and two stress levels (high stress and low stress), using the DSR for the PAV aged binders.

Penetration Test at ambient temperature.

What is claimed is:

1. A method for making a modified asphalt, comprising:

blowing an oxygen-containing gas through a base asphalt at a high gas flow rate while simultaneously agitating the base asphalt at a high shear rate and at an elevated temperature in the range of about 120° C. to about 300° C. for a treatment time to thereby produce a modified asphalt;

wherein the high gas flow rate, the high shear rate, the elevated temperature and the treatment time are all selected to substantially improve both the rutting resistance and the fatigue resistance of the modified asphalt as compared to the base asphalt; and wherein the base asphalt is agitated at a high shear rate supplying an amount of power to the base asphalt that corresponds to shearing a 3.5 kilogram sample at least about 5000 rpm for about one hour.

2. The method of claim 1 in which the substantially improved rutting resistance is evidenced by an accumulated strain value for the modified asphalt that is less than about 50% of the accumulated strain value of the base asphalt.

3. The method of claim 2 in which the accumulated strain values for the modified asphalt and for the base asphalt are determined by a Creep and Recovery test conducted for 100 cycles at 64° C.

4. The method of claim 1 in which the substantially improved fatigue resistance is evidenced by a fatigue life value for the modified asphalt that is at least about twice a fatigue life value for the base asphalt.

5. The method of claim 4 in which the fatigue life values for the modified asphalt and for the base asphalt are determined by a Repeated Cyclic Loading test conducted at 34° C. and 10 Hz.

6. The method of claim 1 in which the oxygen-containing gas comprises air.

7. The method of claim 1 in which agitating the base asphalt at a high shear rate comprises supplying an amount of power to the base asphalt that corresponds to shearing a 3.5 kilogram sample at least about 10,000 rpm for about one hour.

8. The method of claim 1 in which at least a portion of the agitating of the base asphalt at the high shear rate is conducted using an in-line mixer.

9. The method of claim 1 in which the elevated temperature is in the range of about 150° C. to about 250° C.

10. The method of claim 1 further comprising blending the modified asphalt with a second base asphalt to produce a back-blended asphalt, wherein the modified asphalt is blended with the second base asphalt in an amount that is effective to improve both the rutting resistance and the fatigue resistance of the back-blended asphalt as compared to the second base asphalt.

11. A method for making a modified asphalt, comprising:

blowing an oxygen-containing gas through a base asphalt at a high gas flow rate while simultaneously agitating the base asphalt at a high shear rate and at an elevated temperature in the range of about 120° C. to about 300° C. for a treatment time to thereby produce a modified asphalt;

wherein the high gas flow rate, the high shear rate, the elevated temperature and the treatment time are all selected to substantially improve both the rutting resistance and the fatigue resistance of the modified asphalt as compared to the base asphalt; and wherein at least a portion of the agitating of the base asphalt at the high shear rate is conducted using an in-line mixer or a rotor/stator head; and wherein the base asphalt is agitated at a high shear rate supplying an amount of power to the base asphalt that corresponds to shearing a 3.5 kilogram sample at least about 5000 rpm for about one hour.

12. The method of claim 11 in which the substantially improved rutting resistance is evidenced by an accumulated strain value for the modified asphalt that is less than about 50% of the accumulated strain value of the base asphalt.

13. The method of claim 12 in which the accumulated strain values for the modified asphalt and for the base asphalt are determined by a Creep and Recovery test conducted for 100 cycles at 64° C.

14. The method of claim 11 in which the substantially improved fatigue resistance is evidenced by a fatigue life value for the modified asphalt that is at least about twice a fatigue life value for the base asphalt.

15. The method of claim 14 in which the fatigue life values for the modified asphalt and for the base asphalt are determined by a Repeated Cyclic Loading test conducted at 34° C. and 10 Hz.

16. The method of claim 11 in which the oxygen-containing gas comprises air.

17. The method of claim 11 in which agitating the base asphalt at a high shear rate comprises supplying an amount of power to the base asphalt that corresponds to shearing a 3.5 kilogram sample at least about 10,000 rpm for about one hour.

18. The method of claim 11 in which the elevated temperature is in the range of about 150° C. to about 250° C.

19. The method of claim 11 further comprising blending the modified asphalt with a second base asphalt to produce a back-blended asphalt, wherein the modified asphalt is blended with the second base asphalt in an amount that is effective to improve both the rutting resistance and the fatigue resistance of the back-blended asphalt as compared to the second base asphalt.

* * * * *